US007906894B2

(12) United States Patent
Kameda et al.

(10) Patent No.: US 7,906,894 B2
(45) Date of Patent: Mar. 15, 2011

(54) SPARK PLUG FOR INTERNAL COMBUSTION ENGINE

(75) Inventors: Hiroyuki Kameda, Aichi-gun (JP); Tomoaki Kato, Nagoya (JP); Katsutoshi Nakayama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 211 days.

(21) Appl. No.: 12/336,807

(22) Filed: Dec. 17, 2008

(65) Prior Publication Data

US 2009/0160304 A1 Jun. 25, 2009

(30) Foreign Application Priority Data

Dec. 19, 2007 (JP) ..... 2007-327314
Dec. 27, 2007 (JP) ..... 2007-336219

(51) Int. Cl.
*H01T 13/20* (2006.01)

(52) U.S. Cl. ..... 313/141; 313/118; 313/143

(58) Field of Classification Search ..... 313/118, 313/141, 143; 123/169 EL
See application file for complete search history.

(56) References Cited

U.S. PATENT DOCUMENTS

| | | | | |
|---|---|---|---|---|
| 6,819,032 | B2 * | 11/2004 | Matsubara | 313/141 |
| 2007/0080618 | A1 | 4/2007 | Torii et al. | |
| 2007/0216275 | A1 | 9/2007 | Torii et al. | |
| 2007/0216277 | A1 | 9/2007 | Yoshida et al. | |

FOREIGN PATENT DOCUMENTS

| | | | |
|---|---|---|---|
| JP | 7-37676 | A | 2/1995 |
| JP | 11-121142 | A | 4/1999 |
| JP | 2003-17215 | A | 1/2003 |
| JP | 2007-134319 | A | 5/2007 |
| JP | 2007280938 | A | 10/2007 |
| JP | 2007287667 | A | 11/2007 |

* cited by examiner

*Primary Examiner* — Anne M Hines
(74) *Attorney, Agent, or Firm* — Sughrue Mion, PLLC

(57) ABSTRACT

A spark plug includes a ground electrode formed with a flat region and a convex curved region on an outer peripheral surface thereof. The flat region is located on a front end of the ground electrode and has a length of 0.2 mm or more from a front end face of the ground electrode in a longitudinal direction of the ground electrode. The ground electrode satisfies the following dimensional condition (1) with respect to first and second cross sections of the ground electrode taken through the convex curved region and the flat region in directions perpendicular to the longitudinal direction of the ground electrode, $$0.950 \leqq (S2/L2)/(S1/L1) \leqq 0.995 \quad (1)$$

where S1 is the area of the first cross section; L1 is the perimeter of the first cross section; S2 is the area of the second cross section; and L2 is the perimeter of the second cross section.

5 Claims, 22 Drawing Sheets

SPARK PLUG FOR INTERNAL COMBUSTION ENGINE

BACKGROUND OF THE INVENTION

The present invention relates to a spark plug for use in an internal combustion engine. Hereinafter, the term "front" refers to a spark discharge side with respect to the axial direction of a spark plug, and the term "rear" refers to a side opposite the front side.

A spark plug for an internal combustion engine includes a center electrode extending axially of the spark plug, an insulator disposed around the center electrode, a metal shell disposed around the ceramic insulator and a ground electrode joined at a rear end thereof to a front end of the metal shell. In general, the ground electrode is substantially rectangular in cross section and bent in such a manner that a front end of the ground electrode faces a front end of the center electrode to define a spark gap between the front end of the center electrode and the front end of the ground electrode. In some cases, tips of precious metal alloys (precious metal tips) may be joined to the front ends of the center and ground electrodes for improvements in spark wear resistance.

When the spark plug is mounted on a cylinder head of the engine at a position that causes a collision of an air-fuel mixture to an outer (back) surface of the ground electrode, there is a possibility that the ground electrode interferes with the flow of the air-fuel mixture into the spark gap. This results in variations in engine ignition performance.

In order to prevent such ignition performance variations, Japanese Laid-Open Patent Publication No. 11-121142 proposes a spark plug with two or more ground electrodes, each of which is substantially circular in cross section (i.e. substantially cylindrical in shape) so as to allow the air-fuel mixture to easily flow to the inner peripheral side of the ground electrode and then flow to the spark gap even when the spark plug is in a position that causes a collision of the air-fuel mixture to the outer peripheral surface of the ground electrode.

SUMMARY OF THE INVENTION

In recent years, high-compression-ratio, high-output engines have been developed with varying combinations of superchargers and variable valve systems. There have also been developed so-called spray-guide direct-injection engines with injectors to inject fuel directly against highly-compressed air in the engine cylinders. These engines tend to reach a significantly high cylinder temperature. It is conceivable that, by the direct fuel injection under such high-temperature engine conditions, the fuel of relatively low temperature will directly collide against the ground electrode, which has been exposed to high temperature. In this case, the ground electrode gets suddenly cooled by the fuel and thus may suffer a grain defect formation phenomenon (also called a "worm-hole phenomenon") in which some crystal grains fall out of their grain boundaries. The grain defect formation phenomenon is more likely to occur in the case of the cylindrical-shaped ground electrode.

It is therefore an object of the present invention to provide a spark plug for an internal combustion engine, capable of securing improvement in engine ignition performance, without being affected by the inflow direction of an air-fuel mixture, while protecting a ground electrode from grain defect formation under direct fuel injection.

According to an aspect of the present invention, there is provided a spark plug for an internal combustion engine, comprising: a cylindrical metal shell arranged in an axial direction of the spark plug; a cylindrical insulator retained in the metal shell; a column-shaped center electrode disposed in the insulator with a front end thereof protruding from the insulator; and a ground electrode joined a rear end thereof to a front end of the metal shell and bent in such a manner that a front end of the ground electrode extends toward an axis of the spark plug so as to define a spark gap between the front end of the center electrode and the front end of the ground electrode, the ground electrode including a flat region formed on an outer peripheral surface thereof opposite to an inner peripheral surface facing the insulator, the flat region being located on the front end of the ground electrode and having a length of 0.2 mm or more from a front end face of the ground electrode in a longitudinal direction of the ground electrode, any region other than the flat region of the outer peripheral surface of the ground electrode being convex curved, and the ground electrode satisfying the following dimensional condition (1) with respect to a first cross section of the ground electrode taken through the any region other than the flat region in a direction perpendicular to the longitudinal direction of the ground electrode and a second cross section of the ground electrode taken through the flat region in a direction perpendicular to the longitudinal direction of the ground electrode, $0.950 \leqq (S2/L2)/(S1/L1) \leqq 0.995$ (1) where S1 is the area of the first cross section; L1 is the perimeter of the first cross section; S2 is the area of the second cross section; and L2 is the perimeter of the second cross section.

The other objects and features of the present invention will also become understood from the following description.

DESCRIPTION OF THE EMBODIMENTS

Figure 1:
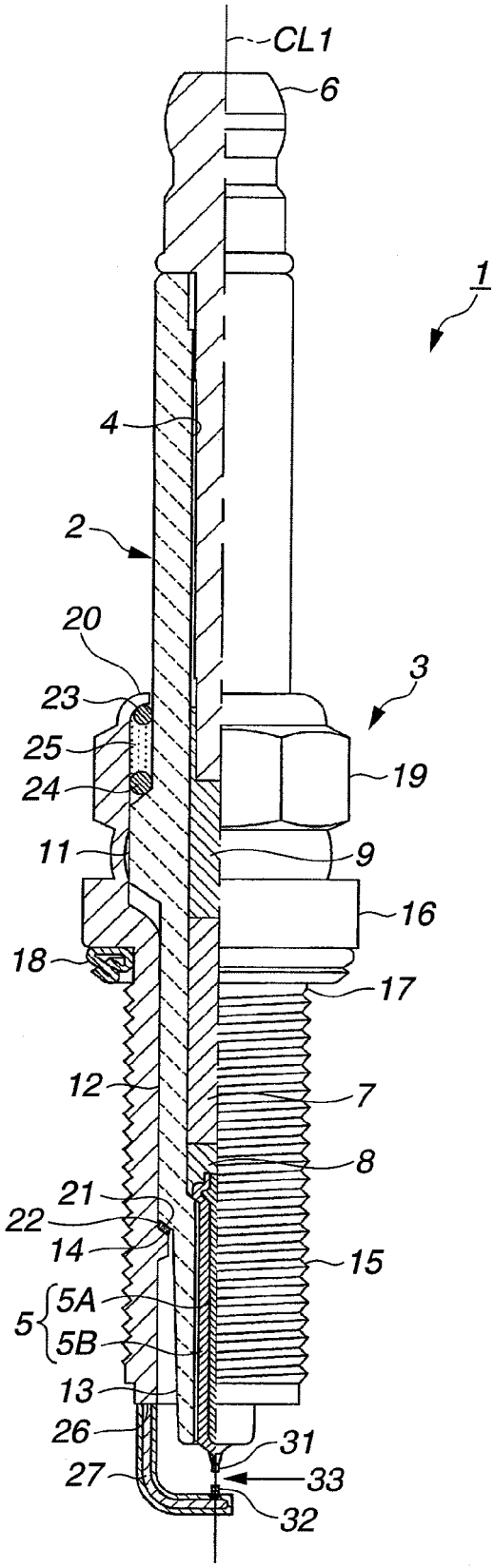
FIG. 1 is a partially cutaway view of a spark plug according to a first embodiment of the present invention.

The present invention will be described in detail below by way of the following embodiments, in which like parts and portions are designated by like reference numerals to eliminate repeated explanations thereof.

A spark plug 1 for an internal combustion engine according to the first embodiment of the present invention will be first explained blow with reference to FIGS. 1 to 10.

Figure 2:
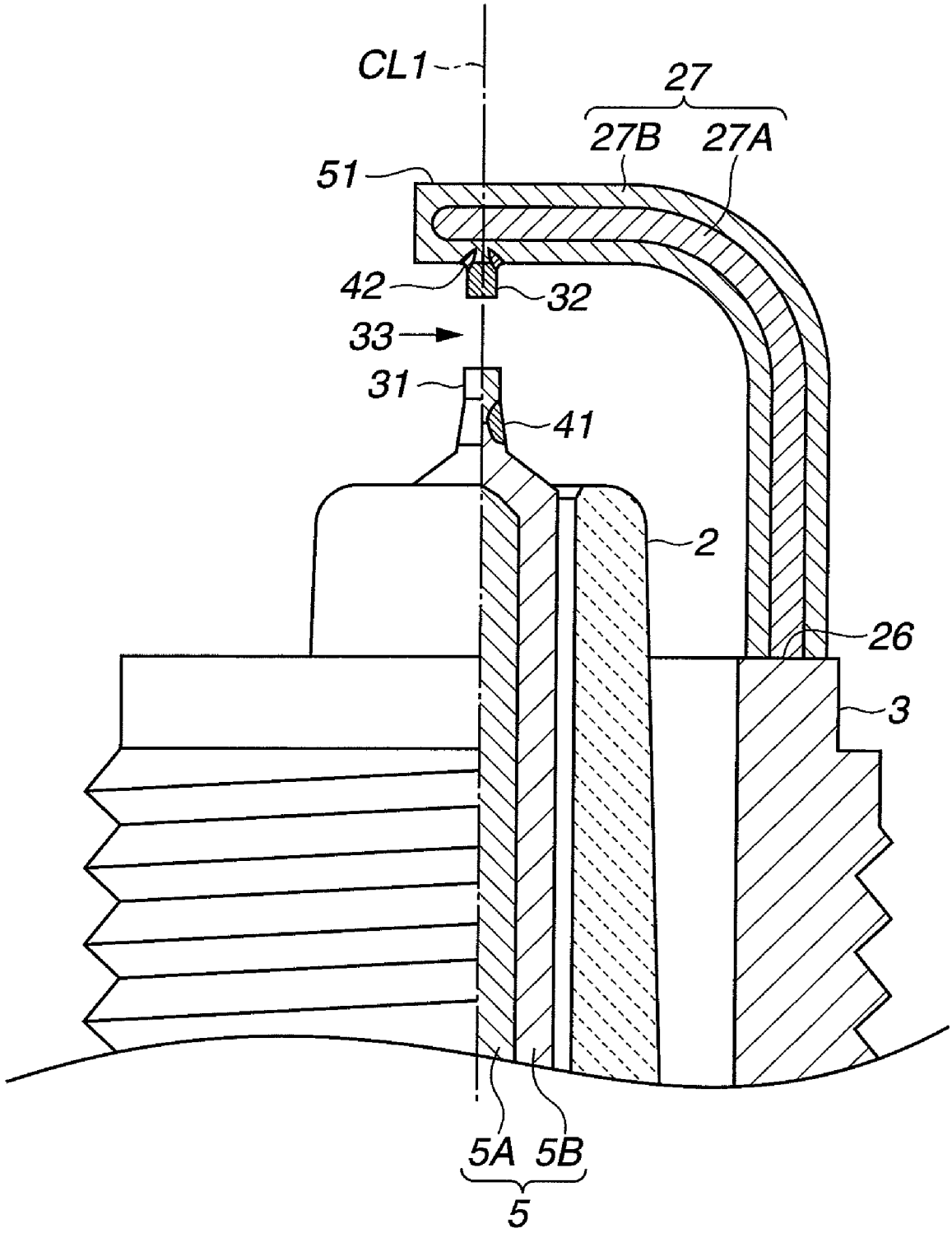
FIG. 2 is an enlarged cross-section view of a front end of the spark plug according to the first embodiment of the present invention.

Referring to FIGS. 1 and 2, the spark plug 1 includes a ceramic insulator 2, a metal shell 3, a center electrode 5 with a precious metal tip 31, a terminal electrode 6, a ground electrode 27 with a precious metal tip 32 and a resistor element 7.

The ceramic insulator 2 is formed into a substantially cylindrical shape, with a through hole 4 thereof extending in the direction of an axis CL1 (hereinafter just referred to as "axial direction") of the spark plug 1, and is made of a sintered ceramic material such as sintered alumina. As shown in FIG. 1, the ceramic insulator 2 includes a flange portion 11 radially outwardly protruding at around an axially middle position of the ceramic insulator 2, a body portion 12 located on a front side of the flange portion 11 and having a smaller diameter than that of the flange portion 11 and a leg portion 13 located on a front side of the body portion 12 and having a smaller diameter than that of the body portion 12. There is a step 14 formed at a location between the body portion 12 and the leg portion 13 on an outer peripheral surface of the ceramic insulator 2.

The metal shell 3 is formed into a cylindrical shape of a metal material such as iron-based material or stainless steel (e.g. low-carbon steel S15C, S25C etc.) and arranged in the axial direction of the spark plug 1 around the outer peripheral surface of the ceramic insulator 2 so as to retain therein the flange portion 11, the body portion 12 and the leg portion 13 of the ceramic insulator 2. In general, the metal shell 3 includes a male-threaded portion 15, a flange portion 16 radially outwardly protruding on a rear side of the threaded portion 15 and a tool engagement portion 19 located on a rear side of the flange portion 16 as shown in FIG. 1. The threaded portion 15 is screwed into a plug hole of a cylinder head of the engine to mount the spark plug 1 onto the engine cylinder head in such a manner that the leg portion 13 of the ceramic insulator 2 is exposed to a combustion chamber of the engine. The flange portion 16 is seated on the engine cylinder head. A gasket 18 is fitted on a thread neck end 17 of the threaded portion 15 and interposed between the flange portion 16 and the engine cylinder head. The tool engagement portion 19 is shaped into a hexagonal cross section for engagement with a tool such as a wrench to screw the threaded portion 15 into the plug hole of the engine cylinder head. Further, there is a step 21 formed on an inner peripheral surface of the metal shell 3 so that the step 14 of the ceramic insulator 2 is engaged on the step 21 of the metal shell 3. The metal shell 3 is swaged at a rear end 20 thereof onto the ceramic insulator 2, with a pair of annular rings 23 and 24 interposed between the ceramic insulator 2 and the metal shell 3 and a talc powder 25 filled between the annular rings 23 and 24, to hold the ceramic insulator 2 and ensure the gastightness between the ceramic insulator 2 and the metal shell 3. In order to hermetically seal the combustion chamber and prevent combustion gas leakage from between the leg portion 13 of the ceramic insulator 2 and the inner peripheral surface of the metal shell 3, an annular plate packing 22 is interposed between the step 14 of the ceramic insulator 2 and the step 21 of the metal shell 3. In this way, the ceramic insulator 2 is fixed in the metal shell 3 via the packing 22, the annular rings 23 and 24 and the talc powder 25 by engaging the step 14 of the ceramic insulator 2 on the step 21 of the metal shell 3 and by swaging the rear end 20 of the metal shell 3 on the ceramic insulator 2.

The center electrode 5 is generally formed into a cylindrical column (rod) shape and fitted in a front side of the through hole 4 of the ceramic insulator 2 in such a manner that a front end of the center electrode 5 protrudes from a front end of the ceramic insulator 2 and gradually decreases in diameter toward its flat end face. In the first embodiment, the center electrode 5 has its body with an inner layer 5A of pure copper or copper alloy and an outer layer 5B of nickel alloy for efficient heat transfer.

The precious metal tip 31 is formed into a cylindrical column shape of precious metal alloy e.g. iridium alloy and joined by welding to the front end face of the center electrode 5 for improvement in spark wear resistance. The welding can be performed by any welding technique such as laser welding or electron-beam welding so as to form a fused joint 41 between the precious metal tip 31 and the center electrode 5 as shown in FIGS. 1 and 2.

The terminal electrode 6 is fitted in a rear side of the through hole 4 of the ceramic insulator 2 in such a manner that a rear end of the terminal electrode 6 protrudes from a rear end of the ceramic insulator 2.

The resistor element 7 is disposed between the center electrode 5 and the terminal electrode 6 within axial through hole 4 of the ceramic insulator 2 and electrically connected at front and rear ends thereof to the center electrode 5 and the terminal electrode 6 via conductive glass seal layers 8 and 9, respectively.

The ground electrode 27 is joined at a rear end thereof to a front end face 26 of the metal shell 3 and is bent at an angle of approximately 90 degrees in such a manner that a front end of the ground electrode 27 is directed toward the plug axis CL1 and substantially faces the front end of the center electrode 5 (the precious metal tip 31). Namely, the front end of the ground electrode 27 extends in the radial direction of the spark plug 1 and substantially faces the front end of the center electrode 5 (the precious metal tip 31) whereas the rear end of the ground electrode 27 extend in the axial direction of the spark plug 1 (i.e. in parallel with the plug axis CL1). Preferably, the ground electrode 27 has its body formed with an inner layer 27A of pure copper or copper alloy and an outer layer 27B of nickel alloy available under the trademark of e.g. Inconel 600 or Inconel 601 in the first embodiment. The formation of such an inner layer 27A enables efficient heat transfer from the inside of the ground electrode 27 since the copper or copper alloy exhibits higher thermal conductivity than the nickel alloy.

The precious metal tip 32 is formed into a cylindrical column shape of precious metal alloy e.g. platinum alloy containing 20 mass % of rhodium and joined by welding to the front end of the ground electrode 27 for improvement in spark resistance. The welding can be performed by any welding technique such as laser welding, electron-beam welding or resistance welding so as to form a fused joint 42 between the precious metal tip 32 and the ground electrode 27 as shown in FIGS. 1 and 2.

With such a configuration, there is a spark gap 33 defined between the front end of the center electrode 5 and the front end of the ground electrode 27, more specifically, between the opposing end faces of the precious metal tips 31 and 32 so that the spark plug 1 generates a spark discharge in the spark gap 33 approximately in the axial direction of the spark plug 1.

Figure 10:
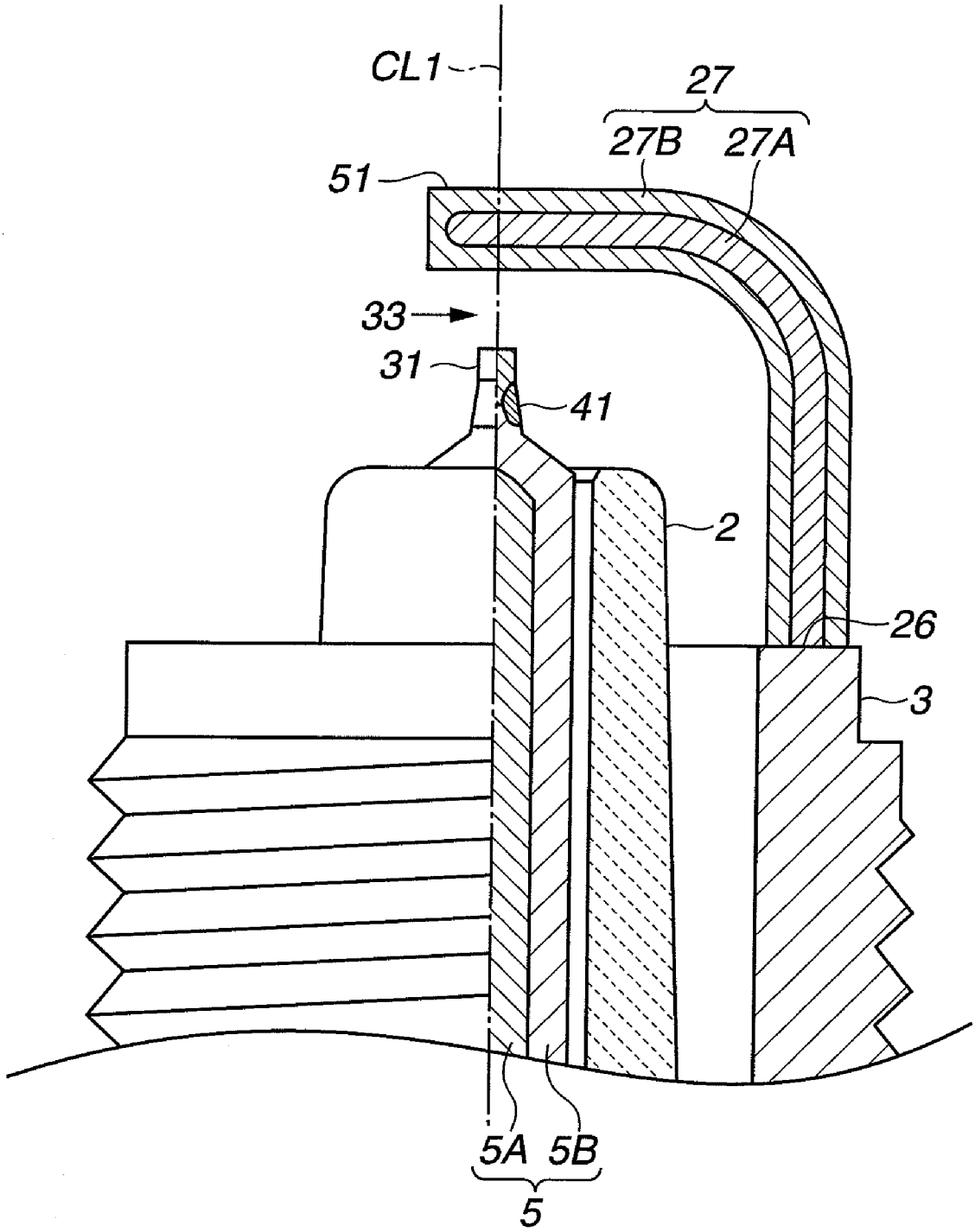
FIG. 10 is an enlarged cross-section view of a modification of the front end of the spark plug according to the first embodiment of the present invention.

Although the precious metal tips 31 and 32 are provided on the respective electrodes 5 and 27 in the first embodiment, these precious metal tips 31 and 32 are not necessarily provided. For example, only the precious metal tip 31 may be provided on the center electrode 5 with no precious metal tip on the ground electrode 27 as shown in FIG. 10. In this case, the spark gap 33 is defined between the precious metal tip 31 and the front end of the ground electrode 27. Only the precious metal tip 32 may alternatively be provided on the ground electrode 27 with no precious metal tip on the center electrode 5. In this case, the spark gap 33 is defined between the front end of the center electrode 5 and the precious metal tip 32. Both of the precious metal tips 31 and 32 may not provided on the center and ground electrodes 5 and 27. In this case, the spark gap 33 is defined between the front ends of the center and ground electrodes 5 and 27.

The materials of the precious metal tips 31 and 32 are not limited to the above. Any other precious metal alloys can be used as the materials of the precious metal tips 31 and 32. Each of the cylindrical precious metal tips 31 and 32 can be obtained by e.g. preparing an ingot of precious metal, alloying the precious metal ingot with alloying metal, forming the resulting molten alloy into an ingot, subjecting the alloy ingot to hot forging and/or hot rolling (grooved rolling), wiredrawing the alloy ingot into a rod shape and then cutting the alloy ingot to a given length.

Figure 3:
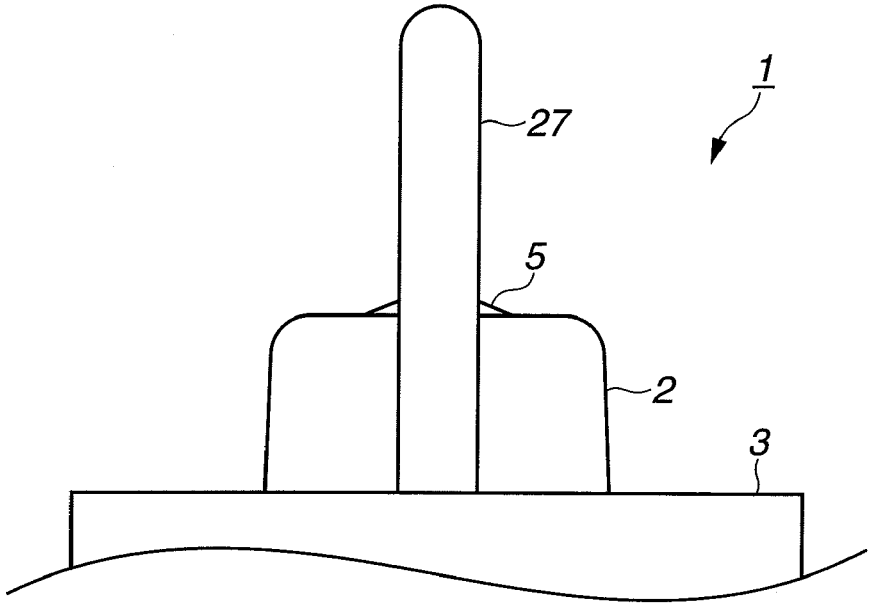
FIG. 3 is a side view of the front end of the spark plug according to the first embodiment of the present invention.
Figure 4:
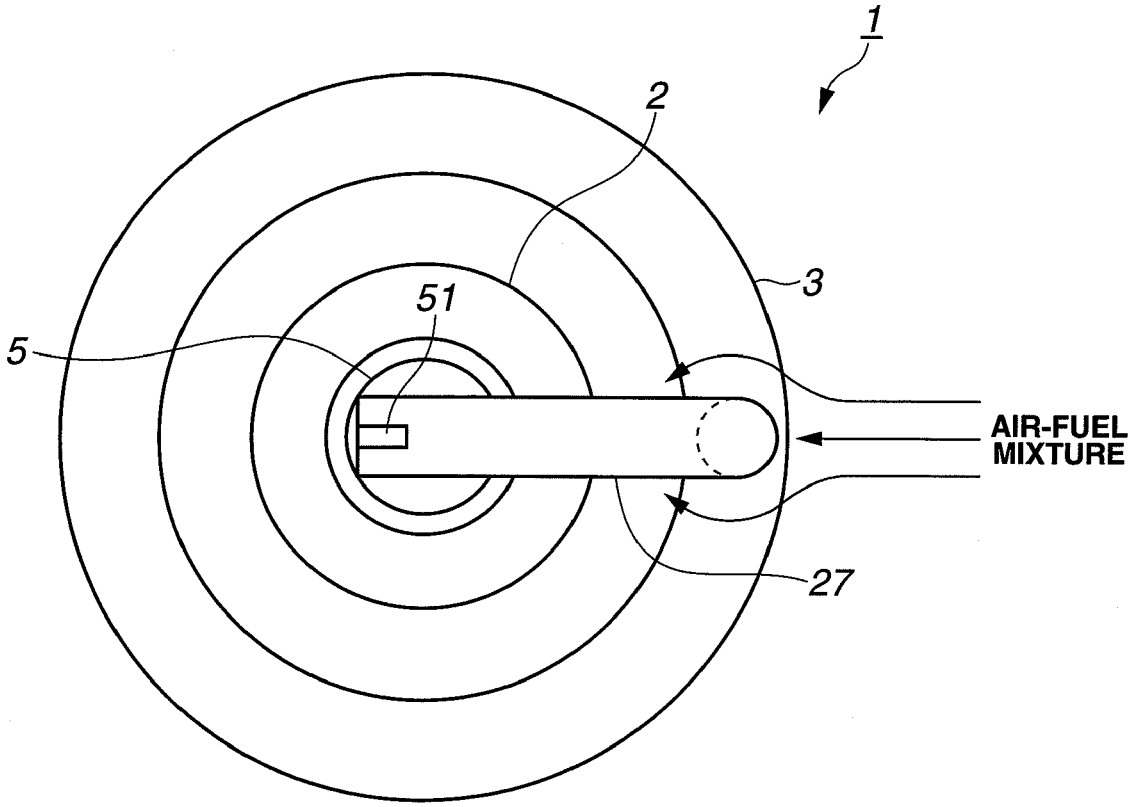
FIG. 4 is a plan view of the front end of the spark plug according to the first embodiment of the present invention.
Figure 5:
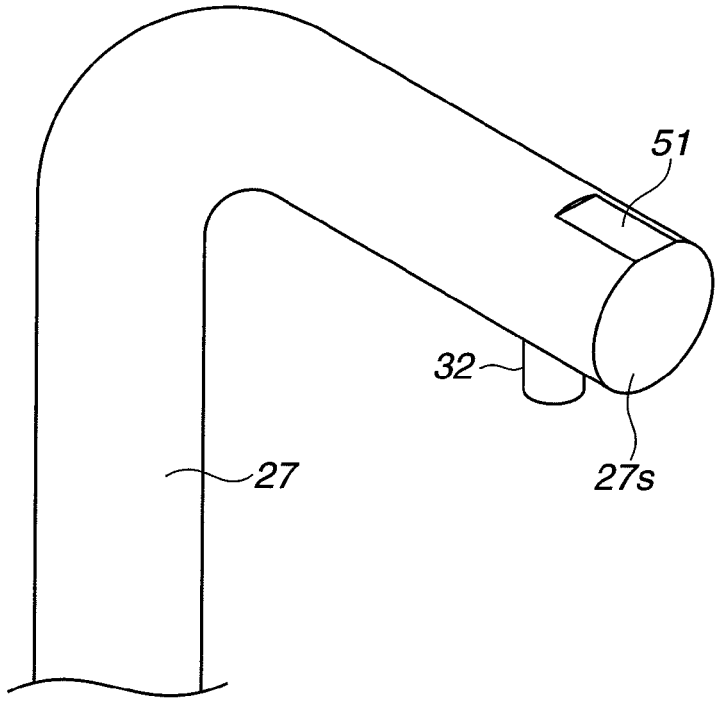
FIG. 5 is a perspective view of a ground electrode of the spark plug according to the first embodiment of the present invention.
Figure 6:
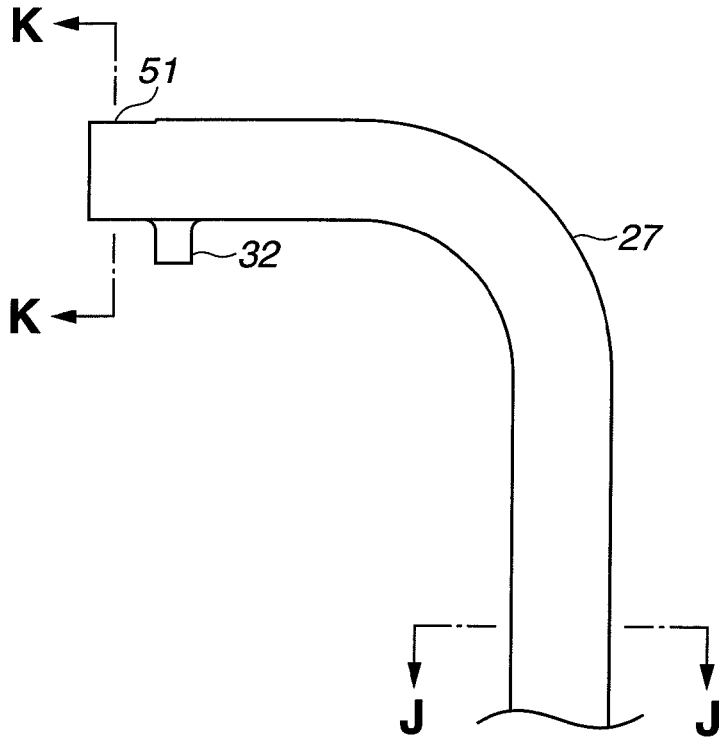
FIG. 6 is a side view of the ground electrode of the spark plug according to the first embodiment of the present invention.
Figure 7A:
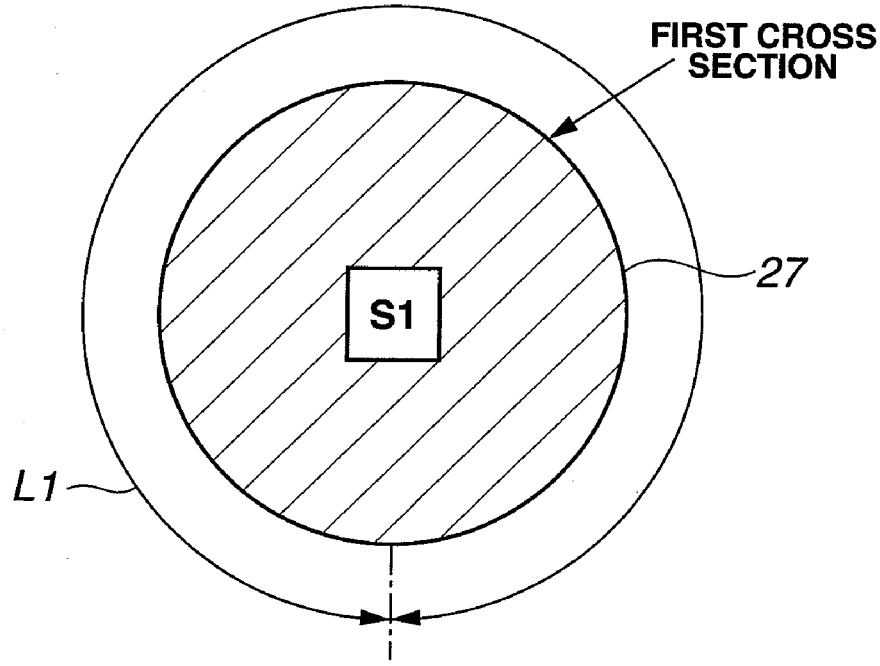
FIG. 7A is a cross-section view of the ground electrode taken along line J-J of FIG. 6.
Figure 7B:
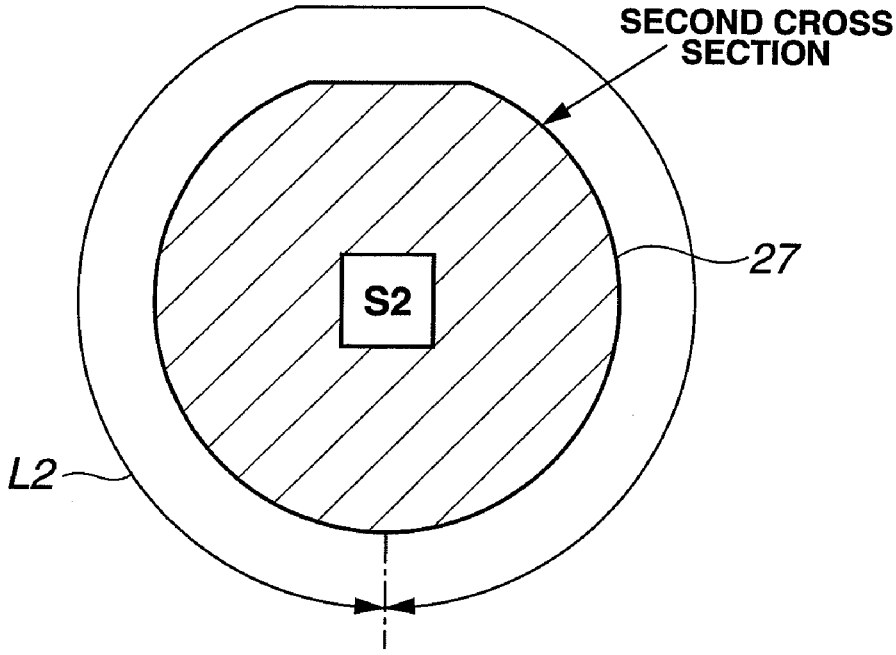
FIG. 7B is a cross-section view of the ground electrode taken along line K-K of FIG. 6

Herein, the spark plug 1 of the first embodiment is characterized in that the ground electrode 27 is substantially circular in cross section with a flat region 51 formed on an outer peripheral surface of the ground electrode 27, which is opposite to an inner peripheral surface of the ground electrode 27 facing the center electrode 5 (ceramic insulator 2) and is visually identified when the ground electrode 27 is viewed from the outside, as shown in FIGS. 3, 4 and 5. Any region, other than the flat region 51, of the outer peripheral surface of the ground electrode 27 is curved into a convex shape, more specifically a circular arc, with a curvature radius of 0.5 to 1.0 mm (hereinafter referred to as "convex curved region").

The flat region 51 is located on the front end of the ground electrode 27 and rectangular-shaped having a length of 0.2 mm or more from a front end face 27*s* of the ground electrode 27 in the longitudinal axis direction of the ground electrode 27 (hereinafter occasionally referred to as "longitudinal length") and a given width of e.g. 0.4 to 1.2 mm, preferably 0.5 to 1.0 mm, more preferably 0.6 to 0.7 mm, in a lateral direction perpendicular to the longitudinal direction of the ground electrode 27 (hereinafter occasionally referred to as "lateral width"). The method of formation of the flat region 51 is not particularly limited. The flat region 51 can be formed by e.g. cutting away or press working a given part of the outer peripheral surface of the front end of the ground electrode 27.

In addition, the ground electrode 27 satisfies the following dimensional condition:

$$0.950 \leqq (S2/L2)/(S1/L1) \leqq 0.995$$

with respect to a first cross section of the ground electrode 27 taken through the convex curved region in a direction perpendicular to the longitudinal direction of the ground electrode 27 (e.g. along line J-J of FIG. 6 across the rear end of the ground electrode 27) and a second cross section of the ground electrode 27 taken through the flat region 51 in a direction perpendicular to the longitudinal direction of the ground electrode 27 (e.g. along line K-K of FIG. 6 across the front end of the ground electrode 27) where S1 is the area of the first cross section; L1 is the perimeter of the first cross section; S2 is the area of the second cross section; and L2 is the perimeter of the second cross section.

Figure 9A:
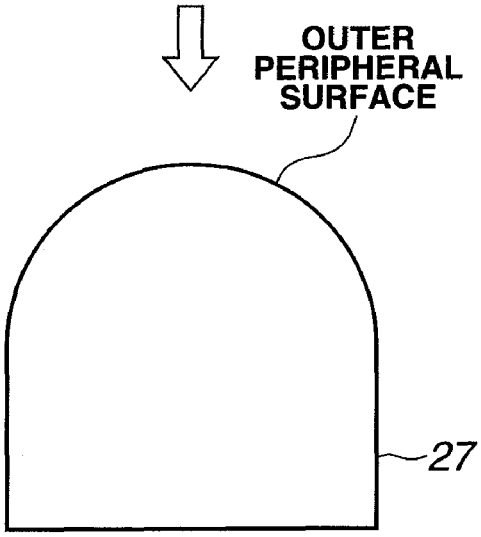
FIGS. 9A, 9B and 9C are schematic views showing the cross-sectional profiles of modifications of the ground electrode according to the first embodiment of the present invention.
Figure 9B:
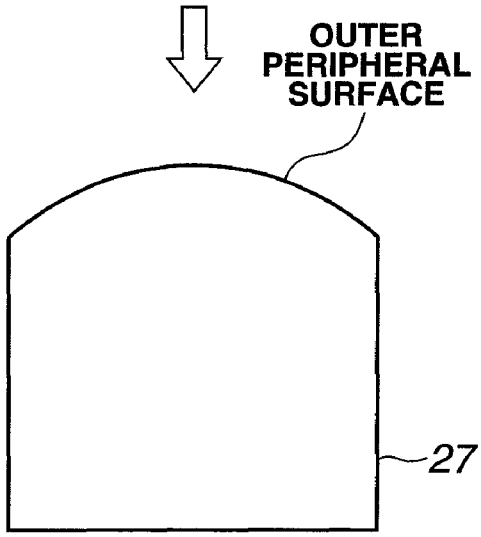
Figure 9C:
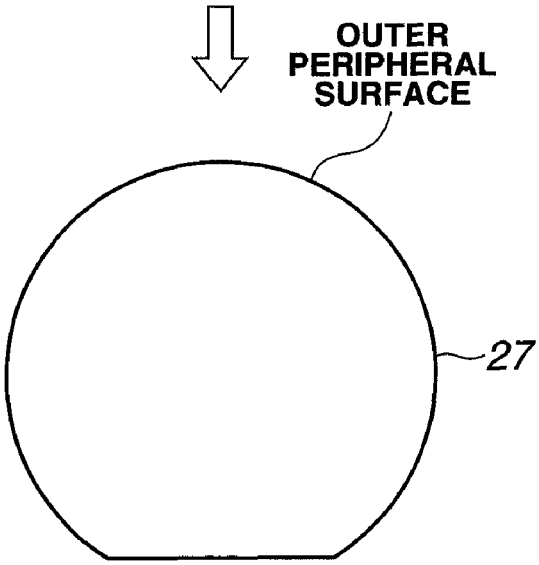
Figure 9D:
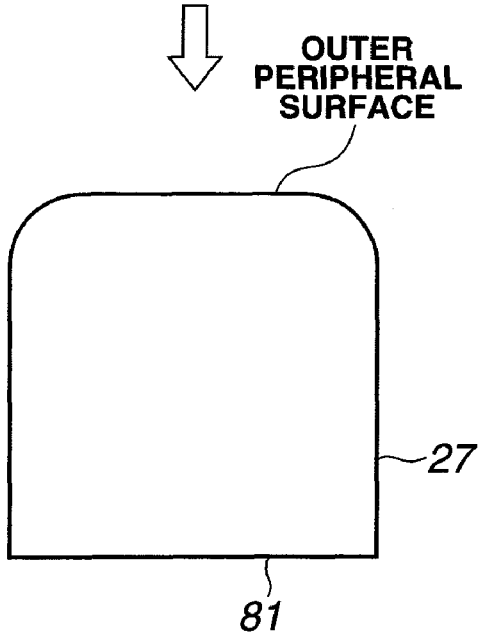
FIG. 9D is a schematic view showing the cross-sectional profile of a ground electrode out of the scope of the present invention.

The form of the ground electrode 27 is not limited to the above. There is no particular limitation on the form of the ground electrode 27 as long as both of the flat region 51 and the convex curved region are made on the outer peripheral surface of the ground electrode 27 to satisfy the dimensional condition of $0.950 \leqq (S2/L2)/(S1/L1) \leqq 0.995$. Various modifications of the ground electrode 27 are possible. For example, the ground electrode 27 can be modified in such a manner that the outer peripheral surface of the ground electrode 27, except for the flat region 51, has a circular arc cross-sectional profile and the inner peripheral surface of the ground electrode 27 has a flat (straight) cross-sectional profile, with flat regions formed on the opposite side surfaces of the ground electrode 27, as shown in FIGS. 9A, 9B and 9C. It is however impractical to modify the ground electrode 27 into a rounded corner rectangular cross section as shown in FIG. 9D since any region, other than the outer rounded corners, of the outer peripheral surface of such a rounded-corner ground electrode is flat and cannot be considered as the convex curved region.

When the spark plug 1 comes into a position that causes a direct collision of fuel and air against the outer peripheral (back) surface of the ground electrode 27, the air-fuel mixture easily flows around the convex curved region of the ground electrode 27 from the outer peripheral side to the inner peripheral side. It is thus possible to ensure the flow of the air-fuel mixture into the spark gap 33 for improvements in engine ignition performance and flame propagation characteristics.

It is however conceivable that, while the front end of the ground electrode 27 becomes the highest in temperature, the fuel of relatively low temperature will directly collide with the outer peripheral surface of the front end of the ground electrode 27. In such a case, the front end of the ground electrode 27 gets suddenly and locally cooled and subjected to large thermal shock upon the direct fuel collision.

Figure 8A:
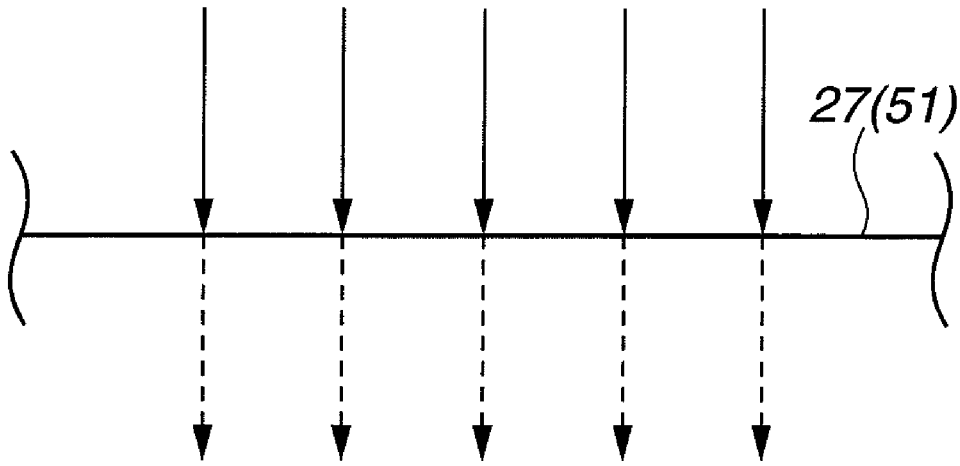
FIG. 8A is a schematic view showing the mechanism of direct collision of fuel against the ground electrode according to the first embodiment of the present invention.
Figure 8B:
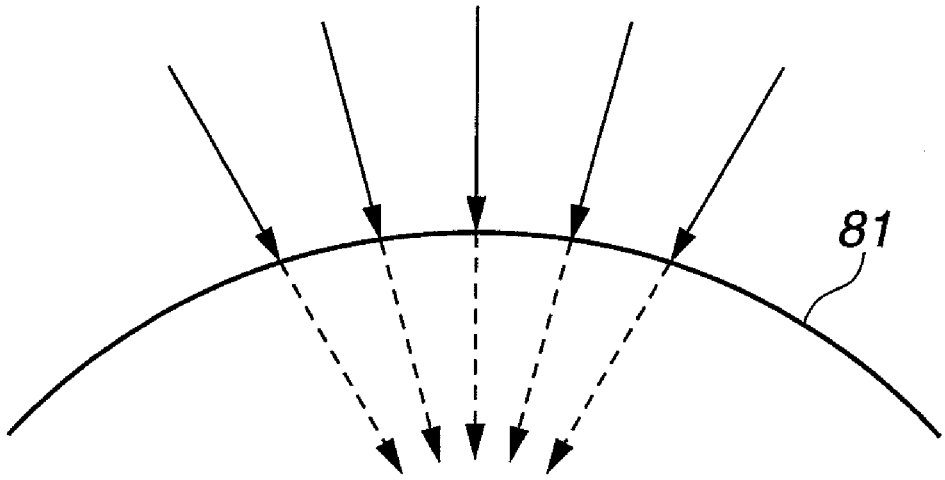
FIG. 8B is a schematic view showing the mechanism of direct collision of fuel against a ground electrode according to the earlier technology.

In the case of using a ground electrode 81 having its whole peripheral surface convex curved with no flat region, it is likely that the thermal shock vectors of the fuel will be concentrated on one point by such a curved peripheral surface of the ground electrode 81 as shown in FIG. 8B. As a result, the ground electrode 81 suffers a grain defect formation phenomenon (also called "wormhole phenomenon") in which some crystal grains fall out of their grain boundaries due to local and sudden cooling.

By contrast, the flat region 51 is formed on the outer peripheral surface of the front end of the ground electrode 27 as explained above in the first embodiment. Even when the fuel directly collides against the outer peripheral side of the front end of the ground electrode 27, the flat region 51 prevents the thermal shock vectors of the fuel from being concentrated on one point as shown in FIG. 8A. It is thus possible to prevent the occurrence of grain defects (wormhole phenomenon) in the ground electrode 27 due to local and sudden cooling of the ground electrode 27 by the fuel. When the longitudinal length of the flat region 51 is less than 0.2 mm or when the condition of $0.950 \leqq (S2/L2)/(S1/L1) \leqq 0.995$ is not satisfied, the flat region 51 may not produce a sufficient grain defect prevention effect so that the grain defects are likely to occur in the ground electrode 27 upon the direct fuel collision. The grain defect prevention effect of the flat region 51 can be ensured sufficiently and assuredly when the longitudinal length of the flat region 51 is 0.2 mm or longer and, at the same time, the condition of $0.950 \leqq (S2/L2)/(S1/L1) \leqq 0.995$ is satisfied.

Furthermore, the convex curved region of the outer peripheral surface of the ground electrode 27 is in circular arc form with a curvature radius of 0.5 to 1.0 mm as explained above. This allows the air-fuel mixture to flow around the convex curved region of the ground electrode 27 more easily and efficiently from the outer peripheral side to the inner peripheral side and reach the spark gap 33 for further improvements in engine ignition performance and flame propagation characteristics. When the curvature radius of the convex curved region is less than 0.5 mm, the distance between the longitudinal axis and the peripheral surface of the ground electrode 27 is so small that the front end of the ground electrode 27 does not become so high in temperature by heat radiation from its peripheral surface. When the curvature radius of the convex curved region exceeds 1.0 mm, there is not so large difference between the convex curved region and the flat region 51 so that the concentration of the thermal shock vectors of the fuel is unlikely occur even on the convex curved region. For these reasons, the grain defect formation phenomenon is originally unlikely to occur by the direct fuel collision when the curvature radius of the convex curved region is less than 0.5 mm and when the curvature radius of the convex curved region exceeds 1.0 mm. In other words, the grain defect prevention effect of the flat region 51 becomes evident and pronounced when the curvature radius of the convex curved region is 0.5 to 1.0 mm.

The above spark plug 1 can be manufactured by the following procedure.

The metal shell 3 is first produced in a semifinished form by preparing a cylindrical metal piece, forming an axial hole by cold forging through the metal piece, and then, cutting the outside shape of the metal piece.

On the other hand, the ground electrode 27 is produced in a straight cylindrical column form by preparing a core metal material and a bottomed cylindrical metal material, inserting the core material in the cylindrical metal material, forming the resulting two-layer cup material into a thin rod shape by cold forming e.g. wiredrawing using a die etc. or by extrusion using a mold and optionally swaging etc, and then, cutting the rod-shaped electrode material to a given length.

The produced straight ground electrode 27 is joined by e.g. resistance welding to the front end face 26 of the metal shell 3. After the welding, weld shear drops are removed from the joint between the metal shell 3 and the ground electrode 27. It is alternatively feasible to, after cold forming the ground electrode 27 into a thin rod shape, weld the ground electrode 27 to the metal shell 3, subject the ground electrode 27 to swaging and then cut the ground electrode 27 to a given length. In such a case, the swaging step can be performed by inserting the ground electrode 27 into a swager (swaging die) from the front end side while holding the metal shell 3. This eliminates the trouble of setting the length of the ground electrode 27 to a longer length so as to secure a portion of the ground electrode 27 to be held at the swaging step.

The thread portion 15 is formed at a given position on the metal shell 3 by component rolling. The thus-obtained subassembly unit of the metal shell 3 and the ground electrode 27 (hereinafter just referred to as "metal shell subassembly unit") is given zinc plating or nickel plating. The metal shell subassembly unit may be further treated by chromating for corrosion resistance improvement.

The front end of the ground electrode 27 is subjected to cutting or press forming, thereby forming the flat region 51 on the outer peripheral surface of the front end of the ground electrode 27. This cutting or press forming step may alternatively be performed before the component rolling of the thread portion 15 and before or after the welding of the ground electrode 27 to the metal shell 3.

The precious metal tip 32 is then joined to the front end of the ground electrode 27 by laser welding, electron-beam welding or resistance welding while being pressed against the front end of the ground electrode 27. For reliable welding, it is feasible to remove the plating of the front end of the ground electrode 27 prior to the welding step or to mask the front end of the ground electrode 27 at the plating step. Either of the joint faces the precious metal tip 32 and the ground electrode 27 may be subjected to any appropriate processing so that these joint faces suit with each other. The precious metal tip 32 may be welded to the front end of the ground electrode 27 after the following assembling (bending) step.

Further, the ceramic insulator 2 is separately produced by e.g. preparing a granulated powder mixture of alumina and binder etc., molding the ceramic power mixture into a cylindrical shape with a rubber press, shaping the ceramic mold by grinding and sintering the ceramic mold in a furnace.

The center electrode 5 is also separately produced by forging the nickel alloy layer 5B and forming the copper or copper alloy layer 5A in the center of the nickel alloy layer 5B.

The precious metal tip 31 is joined to the front end of the center electrode 5 by laser welding or the like.

The ceramic insulator 2, the center electrode 5 with the precious metal tip 31, the resistive element 7 and the terminal electrode 6 are assembled together into a unit (hereinafter referred to as "insulator subassembly unit"). The resistive element 7 is inserted into the through hole 4 of the ceramic insulator 2 followed by preparing glass seal materials from borosilicate glass and metal powder and filling the glass seal materials into the through hole 4 to sandwich the resistive element 7 between the glass seal materials. After that, the center electrode 5 and the terminal electrode 6 are fitted in the front and rear sides of the though hole 4. The glass seal layers 8 and 9 are formed by baking the glass seal materials in a furnace with the center and terminal electrodes 5 and 6 placed under pressure. At this time, a glaze layer may be applied to the rear end portion of the ceramic insulator 2 concurrently. The glaze layer may alternatively be applied in advance to the rear end portion of the ceramic insulator 2.

The metal shell and insulator subassembly units are assembled and fixed together by cold crimping or hot crimping the relatively-thin rear end of the metal shell 3 onto the ceramic insulator 2 so that the metal shell 3 surrounds and retains therein the ceramic insulator 2.

Finally, the ground electrode 27 is bent in such a manner as to define the spark gap 33 between the precious metal tips 31 and 32.

As described above, the spark plug 1 is able to ensure the flow of the air-fuel mixture into the spark gap 33 for improvements in engine ignition performance and flame propagation characteristics, without being affected by the inflow direction of the air-fuel mixture, and to prevent the occurrence of grain defects in the ground electrode 27 even at the direct collision of the fuel against the outer peripheral surface of the front end of the ground electrode 27 by forming the flat region 51 and the convex curved region on the outer peripheral surface of the ground electrode 27.

A spark plug 100 according to the second embodiment of the present invention will be next explained below with reference to FIGS. 11 to 18. The spark plug 100 of the second embodiment is structurally similar to the spark plug 1 of the first embodiment, except for the positional relationship of the center electrode 5, the ground electrode 27 and the precious metal tips 31 and 32.

Figure 11:
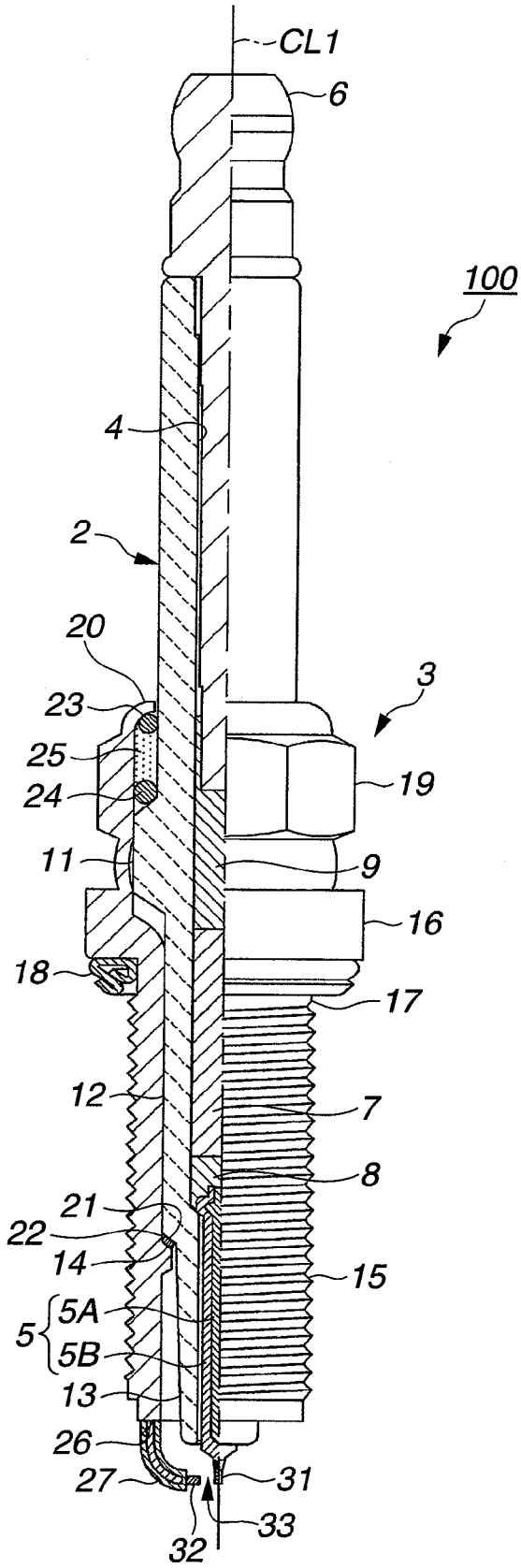
FIG. 11 is a partially cutaway view of a spark plug according to a second embodiment of the present invention.
Figure 12:
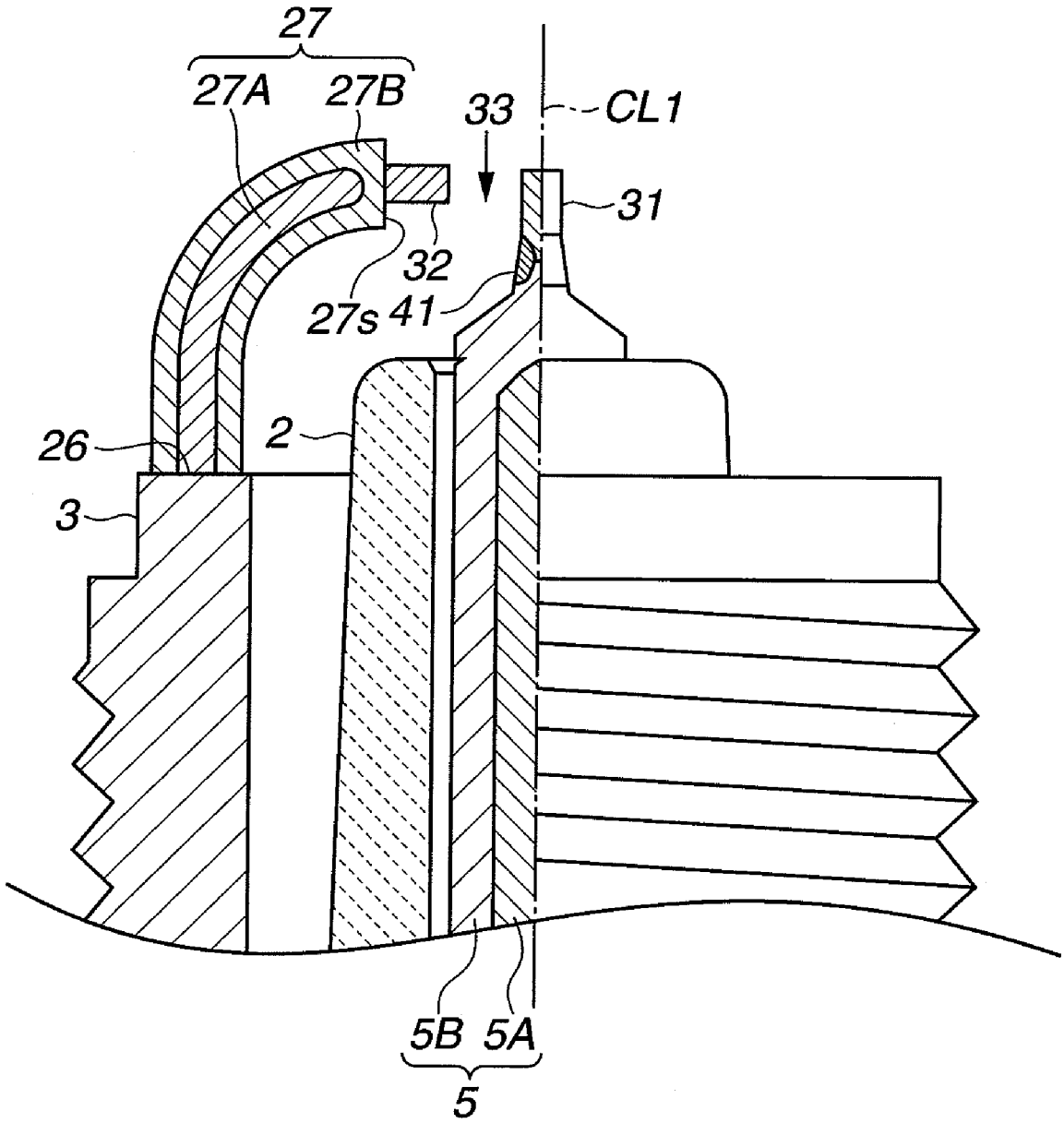
FIG. 12 is an enlarged cross-section view of a front end of a spark plug according to the second embodiment of the present invention.
Figure 13:
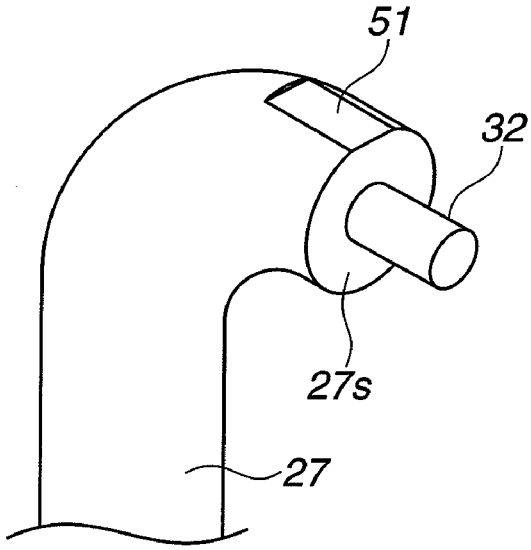
FIG. 13 is a perspective view of a ground electrode of the spark plug according to the second embodiment of the present invention.

As shown in FIGS. 11 and 12, the ground electrode 27 is bent in such a manner that the front end face 27*s* of the ground electrode 27 faces the outer peripheral surface of the precious metal tip 31. The precious metal tip 32 is made smaller in diameter than the front end face 27*s* of the ground electrode 27 and welded to the center of the front end face 27*s* of the ground electrode 27 in such a manner as to protrude toward the axis CL1 of the spark plug 100 from the front end face 27*s* of the ground electrode 27 as shown in FIGS. 11 to 13. With such a configuration, the spark gap 33 is defined between the outer peripheral surface of the precious metal tip 31 and the end face of the precious metal tip 32 so that the spark plug 100 generates a spark discharge in the spark gap 33 approximately in the radial (lateral) direction of the spark plug 100 for improvements in engine ignition performance and flame propagation characteristics. Although the precious metal tip 31 is joined to the front end of the center electrode 5 in the second embodiment, the precious metal tip 31 is not necessarily provided. In this case, the spark gap 33 is defined between the outer peripheral surface of the front end of the center electrode 5 and the end face of the precious metal tip 32.

Figure 16A:
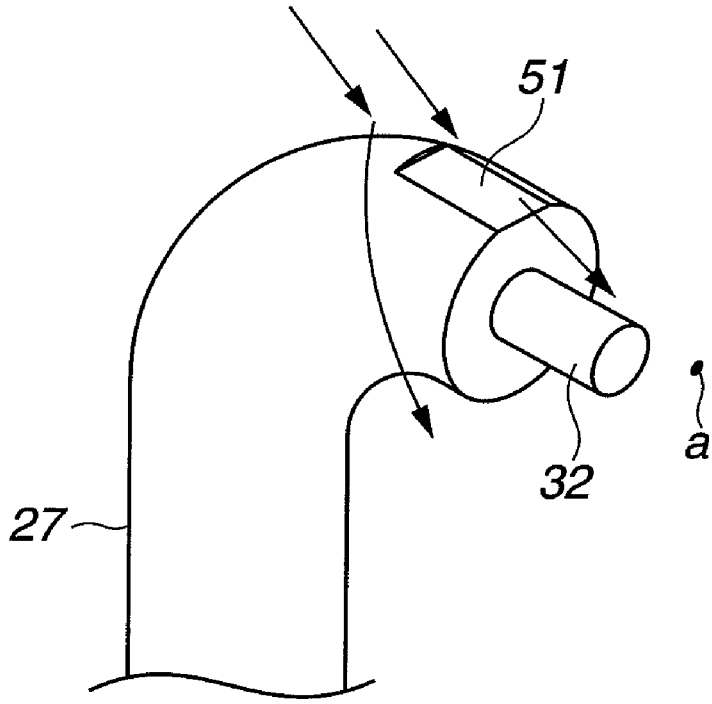
FIG. 16A is a schematic view showing the flow of an air-fuel mixture to and around the ground electrode according to the second embodiment of the present invention.
Figure 16B:
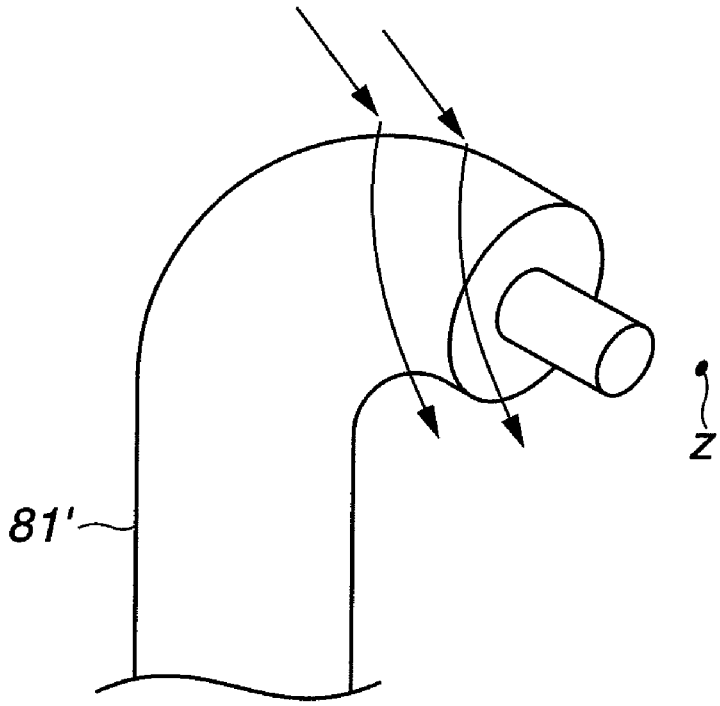
FIG. 16B is a schematic view showing the flow of an air-fuel mixture to and around a ground electrode according to the earlier technology.

In the case of using a cylindrical ground electrode 81' with no flat region, however, there is a possibility that the air-fuel mixture, when collides diagonally with the outer peripheral surface of the front end of the ground electrode 81', flows to the inner peripheral surface of the ground electrode 81' and does not reach a proper discharge point z in the spark gap 33 as shown in FIG. 16B. This results in engine ignition performance deterioration.

In the second embodiment, both of the flat region 51 and the convex curved region are formed on the outer peripheral surface of the ground electrode 27. The convex curved region allows the air-fuel mixture to easily flow therearound from the outer peripheral side to the inner peripheral side and then into the spark gap 33. Further, the flat region 51 produces the effect of not only preventing a concentration of the thermal shock vectors of the fuel but also guiding the air-fuel mixture to a proper discharge point a in the spark gap 33 without causing the flow of the air-fuel mixture to the inner peripheral side as shown in FIG. 16A even when the air-fuel mixture collides diagonally with the outer peripheral surface of the front end of the ground electrode 27. It is thus possible in the second embodiment to ensure the flow of the air-fuel mixture into the spark gap 33 and prevent the occurrence of grain defects in the ground electrode 27 at the direct collision of the fuel against the outer peripheral surface of the front end of the ground electrode 27, as is the case with the first embodiment, by the formation of the flat region 51 and the convex curved region on the outer peripheral surface of the ground electrode 27.

In order for the flat region 51 to guide the air-fuel mixture to the spark gap 33 more stably and efficiently and thereby secure improved ignition performance assuredly, it is preferable to control an angle θ of the front edge of the ground electrode 27 defined by the flat region 51 and the front end face 27*s* as appropriate in consideration of the air-fuel mixture inflow direction. It is particularly preferable that the angle θ which the flat region 51 forms with the front end face 27*s* of the ground electrode 27 is in the range of 70 to 100 degrees. In the second embodiment, the flat region 51 is substantially orthogonal (perpendicular) to the front end face 27*s* of the ground electrode 27, with the flat region 51 oriented in the radial direction of the spark plug 100 and the front end face 27*s* of the ground electrode 27 oriented in the axial direction of the spark plug 100, so that the edge angle θ between the flat region 51 and the front end face 27*s* of the ground electrode 27 is about 90 degrees.

Figure 14A:
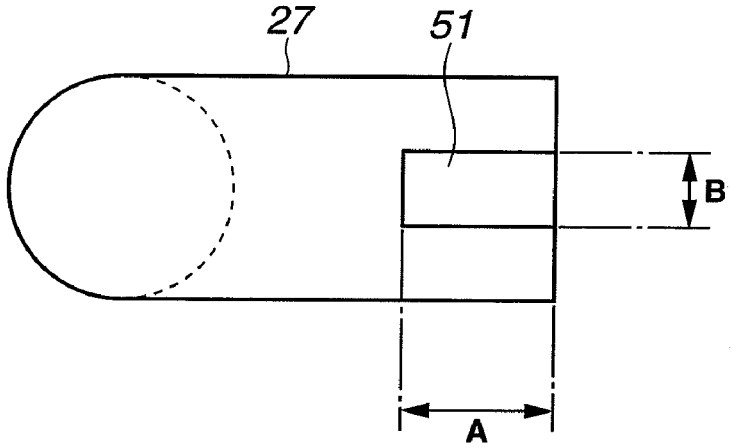
FIG. 14A is a plan view of the ground electrode of the spark plug according to the second embodiment of the present invention.
Figure 14B:
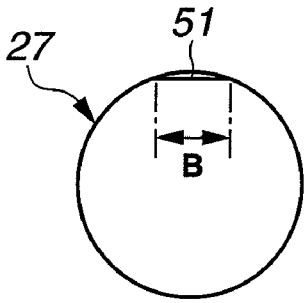
FIG. 14B is an end view of the ground electrode of the spark plug according to the second embodiment of the present invention.

In order for the flat region 51 to guide the air-fuel mixture to the spark gap 33 more stably and efficiently and thereby secure improved ignition performance assuredly, it is also preferable that the flat region 51 satisfies the following dimensional conditions:

$$A \times B \geqq 0.2; \text{ and}$$

$$B \geqq 0.2$$

where A (mm) is the longitudinal length of the flat region 51 in the longitudinal direction of the ground electrode 27 and B (mm) is the lateral width of the flat region 51 as shown in FIGS. 14A and 14B.

Figure 15:
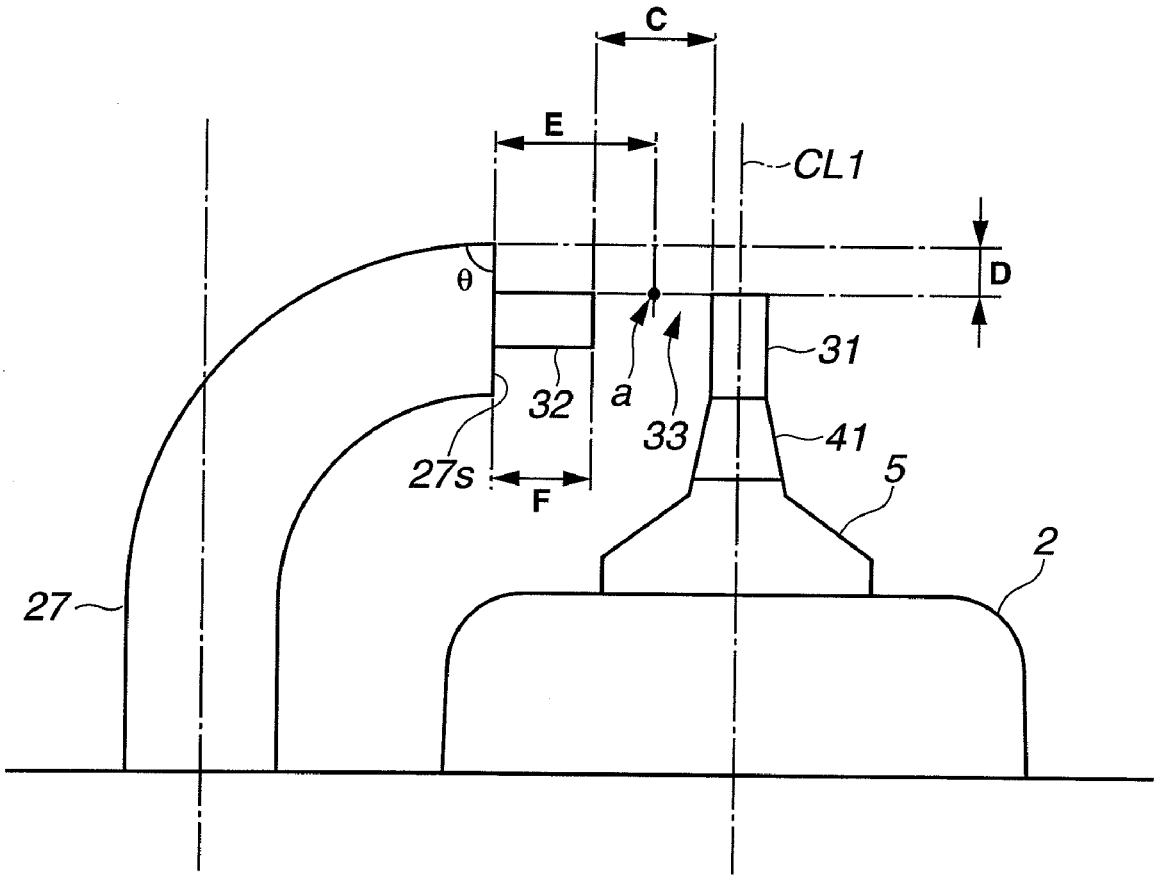
FIG. 15 is a schematic view showing the dimensional configuration of the front end of the spark plug according to the second embodiment of the present invention.

In order to achieve further improvement in ignition performance and secure the durability of the precious metal tip 32, it is further preferable that the spark plug 100 satisfies the following dimensional conditions:

$E \geqq 2 \times D$ when $0.3 \leqq D \leqq C/4+0.8$;

$E \geqq 0.6$ when $D<0.3$; and $F \leqq 1.6$ where C (mm) is the minimum distance of the spark gap 33 in the radial direction of the spark plug 100; D (mm) is the distance from a midpoint a of the shortest line connecting a front edge of the end face of the precious metal tip 31 and a front edge of the end face of the precious metal tip 32 (in the case of no precious metal tip on the center electrode 5, a midpoint of the shortest line connecting an edge of the front end face of the center electrode 5 and a front edge of the end face of the precious metal tip 32) to the outer peripheral surface of the front end of the ground electrode 27 in the axial direction of the spark plug 100; E (mm) is the distance from the midpoint a to the front end face 27*s* of the ground electrode 27 in the radial direction of the spark plug 100; and F (mm) is the length of protrusion of the precious metal tip 32 from the front end face 27*s* of the ground electrode 27 as shown in FIG. 15. By controlling the protrusion length F of the precious metal tip 32 to 1.6 mm or smaller, the precious metal tip 32 can be effectively prevented from deterioration in heat transfer performance. In the case of $D<0.3$ (mm), the above-mentioned effect of the flat region 51 can be obtained more assuredly by satisfying the condition of $E \geqq 0.6$. In the case of $D \geqq 0.3$ (mm), the above-mentioned effect of the flat region 51 can also be obtained more assuredly by satisfying the condition of $E \geqq 2 \times D$. In this case, the upper limit of the distance D is set to $C/4+0.8$ (mm) since the equation $2D-C/2 \leqq 1.6$ (mm) holds based on the equations $F \geqq 1.6$ and $F=E-C/2$.

Figure 17A:
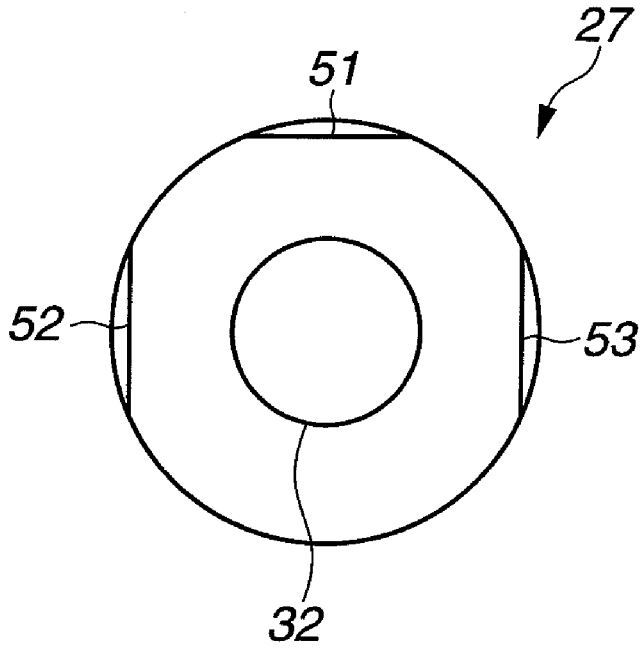
FIG. 17A is an end view of a modification of the ground electrode according to the first or second embodiment of the present invention.
Figure 17B:
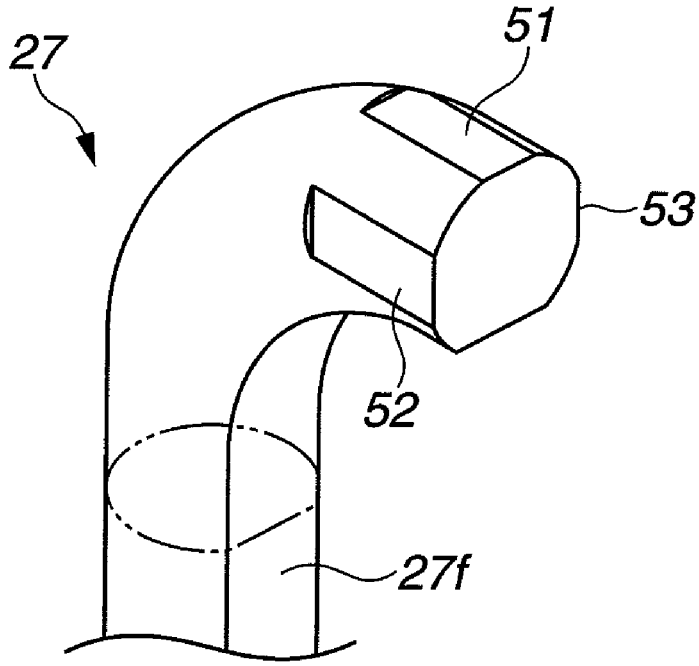
FIG. 17B is a perspective view of another embodiment of the ground electrode according to the first or second embodiment of the present invention.
Figure 18:
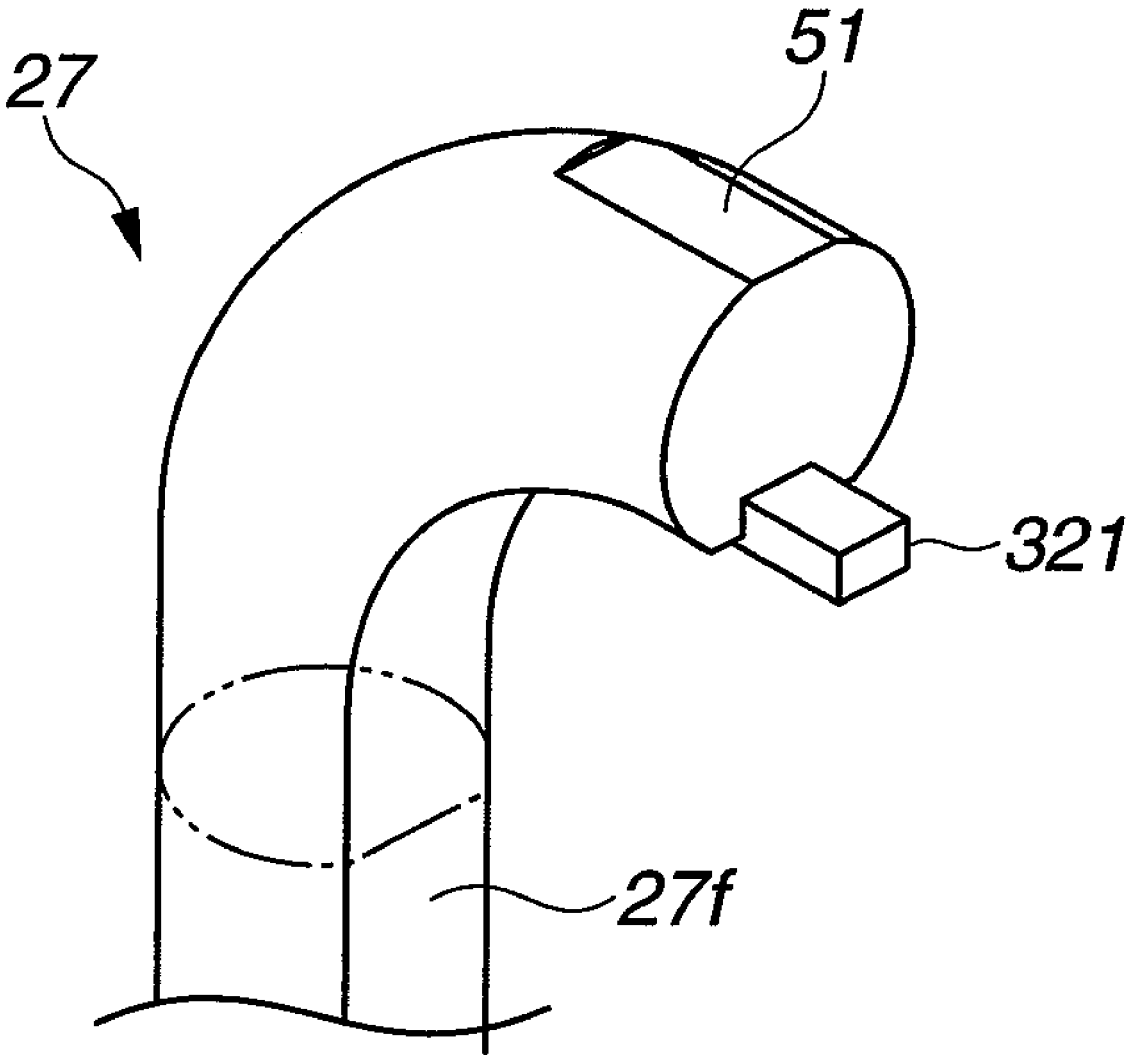
FIG. 18 is a perspective view of still another embodiment of the ground electrode according to the first or second embodiment of the present invention.

The form of the ground electrode 27 can be modified as appropriate in the second embodiment. For example, flat regions 52 and 53 may also be formed on the opposite side surfaces of the front end of the ground electrode 27 as shown in FIG. 17A so as to guide the air-fuel mixture to the spark gap 33 more stably when the air-fuel mixture flows diagonally against the ground electrode 27. As shown in FIG. 17B, the ground electrode 27 may be formed into a substantially semicylindrical shape with a flat inner surface 27*f*. In the case of the ground electrode 27 being in semicylindrical form with the flat inner surface 27*f*, a rectangular precious metal tip 321 may be partly arranged on, or embedded in, and joined by e.g. resistance welding to the flat inner surface 27*f* of the ground electrode 27 so as to protrude from the front end face of the ground electrode 27 toward the spark plug axis as shown in FIG. 18.

The present invention will be described in more detail by reference to the following examples. It should be however noted that the following examples are only illustrative and not intended to limit the invention thereto.

EXPERIMENT 1

Test samples of the spark plug 1 (as Examples) were produced by varying the longitudinal length A of the flat region 51, the area S1 and perimeter L1 of the first cross section of the ground electrode 27 and the area S2 and perimeter L2 of the second cross section of the ground electrode 27.

Each of the test samples was subjected to durability test. The durability test was herein conducted by mounting the test sample in a 2.0-L direct-injection engine, driving the engine continuously for 920 hours according to a highway driving simulation pattern (corresponding to about 100,000 km driving). Before and after the durability test, the cross section of the ground electrode 27 (up to 2 mm in length from the front end face 27*s* of the ground electrode 27) was monitored by CT scanning to measure the cross-section area of the ground electrode 27. The ratio of the cross-section area ratio of the ground electrode 27 after the durability test to the cross-section area of the ground electrode 27 before the durability test was calculated for evaluation of the minimum cross-section area ratio. It can be said that, the smaller the cross-section area ratio, the higher degree of wear, i.e., the likelier the grain defect formation phenomenon (wormhole phenomenon) is to occur in the ground electrode 27. The test results are indicated in FIG. 20.

Test samples of comparative spark plugs (as Comparative Examples) were produced and subjected to durability test in the same manner, except for the longitudinal length of the flat region and the condition of the areas and perimeters of the first and second cross sections of the ground electrode. The test results are also indicated in FIG. 20.

Figure 20:
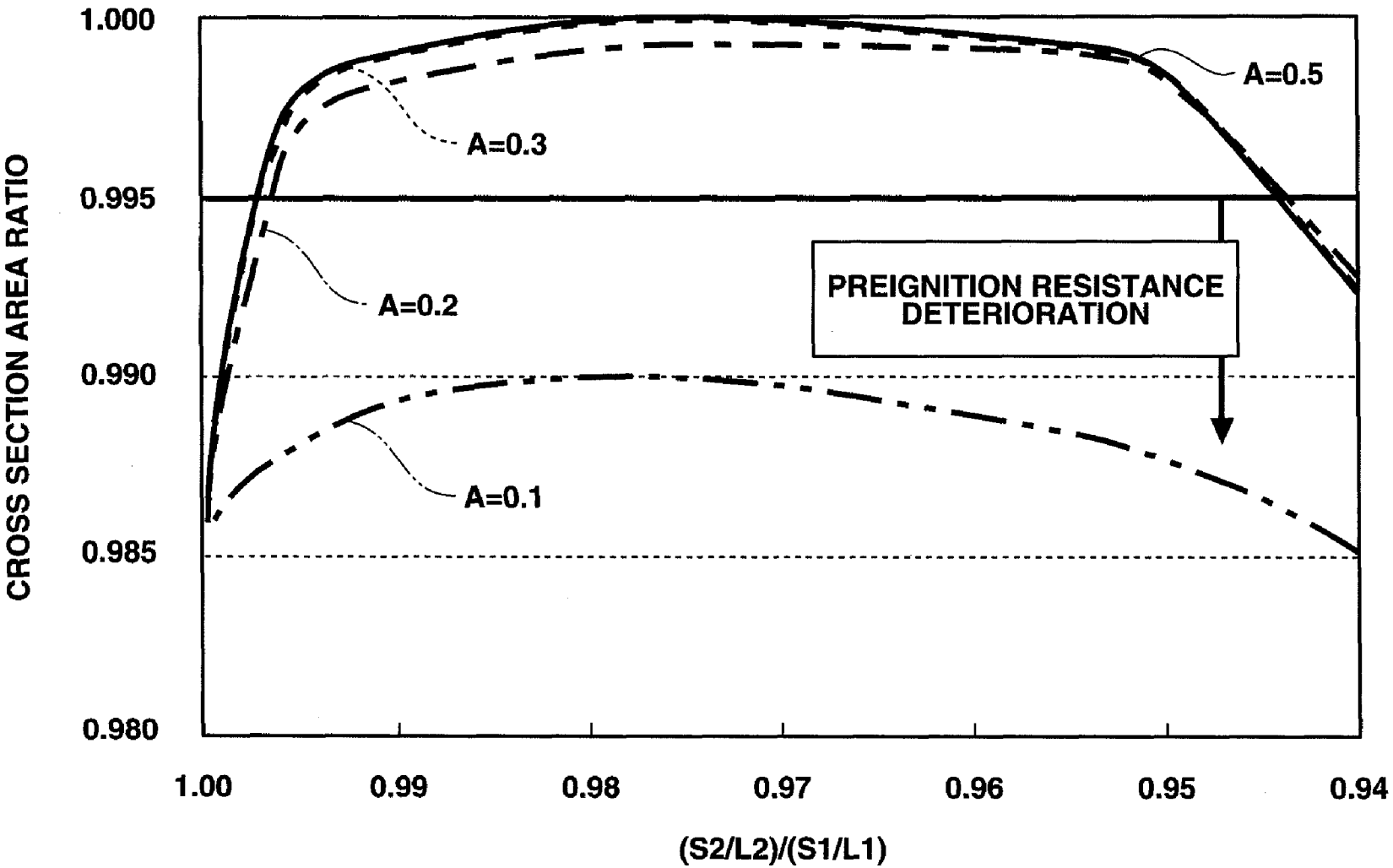
FIG. 20 is a graph showing the results of durability test in Experiment 1.

As seen from FIG. 20, the cross-section area ratio was significantly small when $A<0.2$ mm (e.g. $A=0.1$ mm). The cross-section area ratio was large when $A \geqq 0.2$ mm and, in particular, remained relatively large when $A \geqq 0.2$ mm and $0.950 \leqq (S2/L2)/(S1/L1) \leqq 0.995$. When $(S2/L2)/(S1/L1) <0.950$ or $(S2/L2)/(S1/L1)>0.995$, there was some decrease in the cross-section area ratio regardless of whether $A \geqq 0.2$ mm. It has been thus shown by this experiment that the occurrence of the grain defect formation phenomenon in the ground electrode 27 can be prevented effectively by forming the flat region 51 on the ground electrode 27 under the conditions of $A \geqq 0.2$ mm and $0.950 \leqq (S2/L2)/(S1/L1)>0.995$.

Further, the likelihood of occurrence of preignition due to a decrease in the cross-section area ratio was tested on each of the test samples. The test was conducted by mounting the test sample in a 2.0-L six-cylinder engine, driving the engine continuously at full throttle and detecting the ignition timing (° CA) at which the preignition occurred. When the grain defect formation phenomenon occurs (i.e. the cross-section area ratio becomes decreased), the edges of the grain defects are pointed. Such pointed edges are likely to accumulate heat and thereby become high in temperature so that ignition combustion occurs, prior to a given ignition timing, staring from these pointed edges. It can be thus said that the preignition resistance decreases as the cross-section area ratio becomes small. The test results are indicated in FIG. 21.

Figure 21:
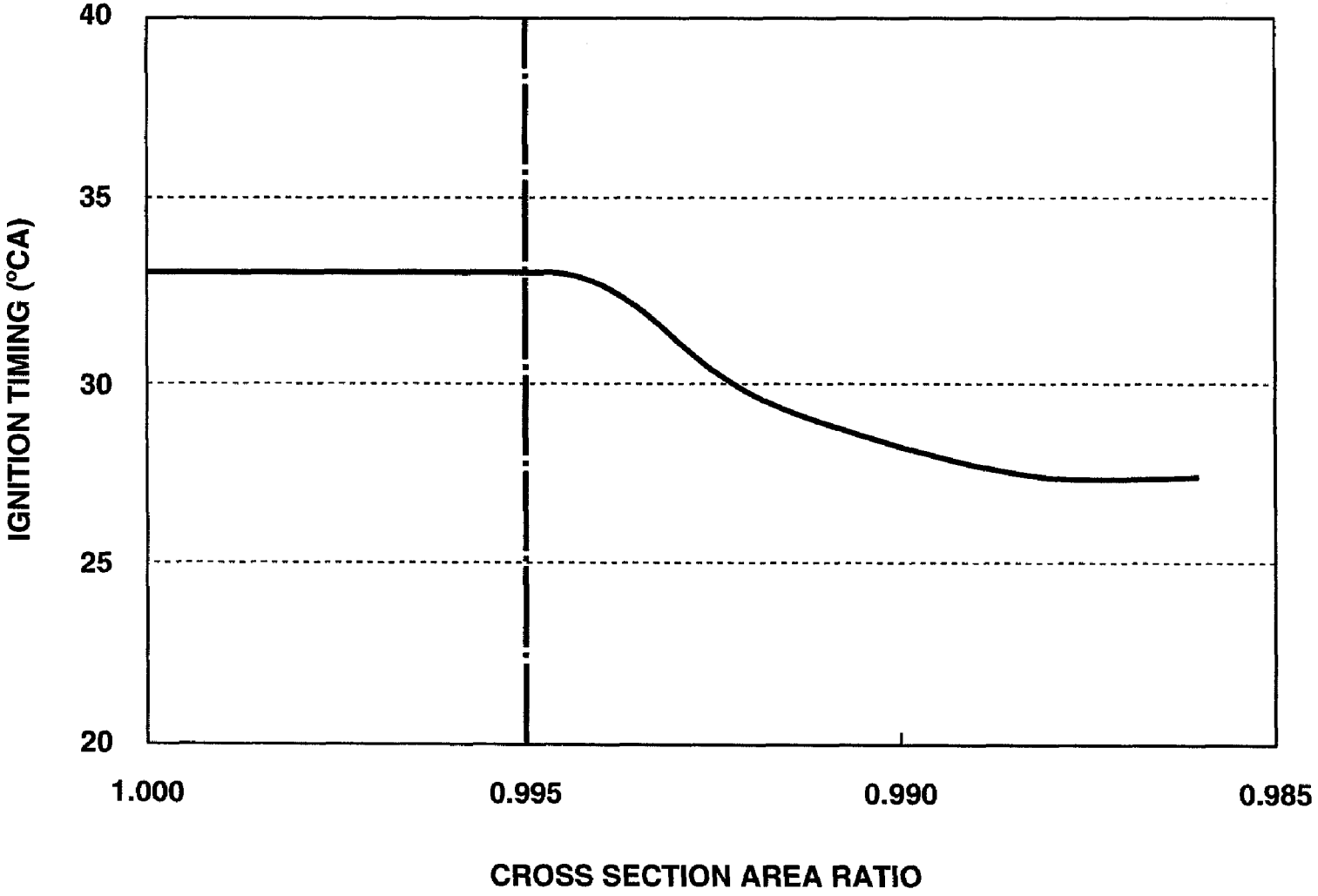
FIG. 21 is a graph showing the relationship between ignition timing and cross section area ratio in Experiment 1.

As seen from FIG. 21, the ignition timing at which the preignition occurred remained around BTDC 33 degrees (corresponding to the full-throttle load) when the cross-section area ratio was larger than or equal to 0.995. When the cross-section area ratio was smaller than 0.995, however, the ignition timing at which the preignition occurred was retarded. Namely, the preignition occurred even under more moderate conditions when the cross-section area ratio was smaller than 0.995. It has been shown that the preignition resistance can be prevented from deterioration when the cross-section area ratio of the ground electrode 27 becomes 0.995 or larger by satisfaction of the conditions of $A \geqq 0.2$ mm and $0.950 \leqq (S2/L2)/(S1/L1) \leqq 0.995$.

EXPERIMENT 2

Test samples of the spark plug 1 (as Examples) were produced and subjected to durability test in the same manner as in Experiment 1 by varying the radius R of the ground electrode 27 (the curvature radius of the outer peripheral surface of the ground electrode 27) to 0.4 mm, 0.5 mm, 0.8 mm, 1.0 mm and 1.1 mm while fixing the longitudinal length A of the flat region 51 at 0.3 mm. Test samples of comparative spark plugs (as Comparative Examples) were also produced and subjected to durability test in the same manner, except for the condition of the areas and perimeters of the first and second cross sections of the ground electrode. The test results are indicated in FIG. 22.

Figure 22:
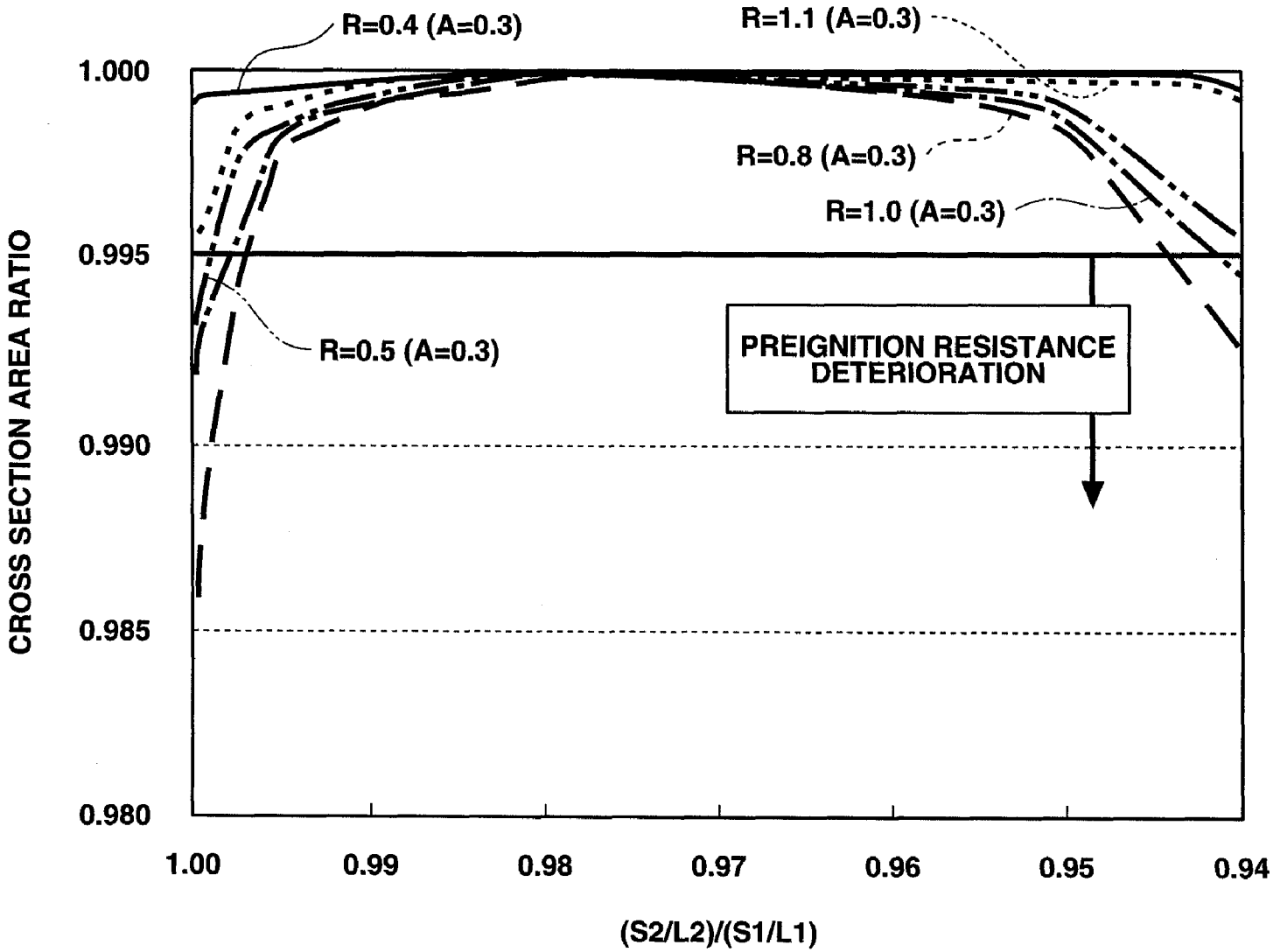
FIG. 22 is a graph showing the results of durability test in Experiment 2.

As seen from FIG. 22, the cross-section area ratio was prevented from decreasing when 0.5 mm≦R≦1.0 mm and 0.950≦(S2/L2)/(S1/L1)≦0.995. It has been confirmed that the occurrence of grain defect formation (wormhole phenomenon) in the ground electrode 27 can be prevented more effectively by satisfaction of the conditions of 0.5 mm≦R≦1.0 mm and 0.950≦(S2/L2)/(S1/L1)≦0.995. Regardless of whether 0.950≦(S2/L2)/(S1/L1)≦0.995, there was no or less decrease in the cross-section area ratio when R<0.5 mm and when R>1.0 mm. This leads to the assumptions that: when R<0.5 mm, the distance between the longitudinal axis and the peripheral surface of the ground electrode 27 was so small that the front end of the ground electrode 27 did not become so high in temperature by heat radiation from its peripheral surface; and that there was not so large difference between the convex curved region and the flat region 51 as to cause the concentration of the thermal shock vectors of the fuel even on the convex curved region when R>1.0 mm. It can be concluded that the grain defects are originally unlikely to occur so that the significance of forming the flat region 51 to satisfy the condition of 0.950≦(S2/L2)/(S1/L1)≦0.995 is small when R<0.5 mm and when R>1.0 mm.

EXPERIMENT 3

A test sample of the spark plug 100 (as Example) was produced. In the test sample, the ground electrode 27 was circular in cross section with a diameter of 1.6 mm. The flat region 51 was formed with a longitudinal length A of 1.0 mm and a lateral width B of 0.4 mm on the outer peripheral surface of the front end of the ground electrode 27. Further, the dimensions of the test sample were controlled to C=0.9 mm, D=0.425 mm and E=1.45 mm.

Figure 23A:
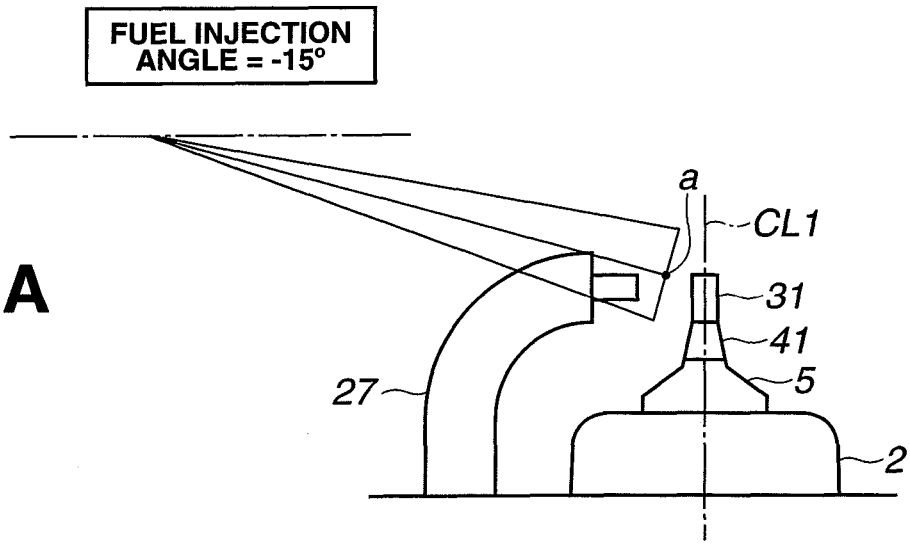
FIGS. 23A, 23B and 23C are schematic view showing fuel injection angles in Experiment 3.
Figure 23B:
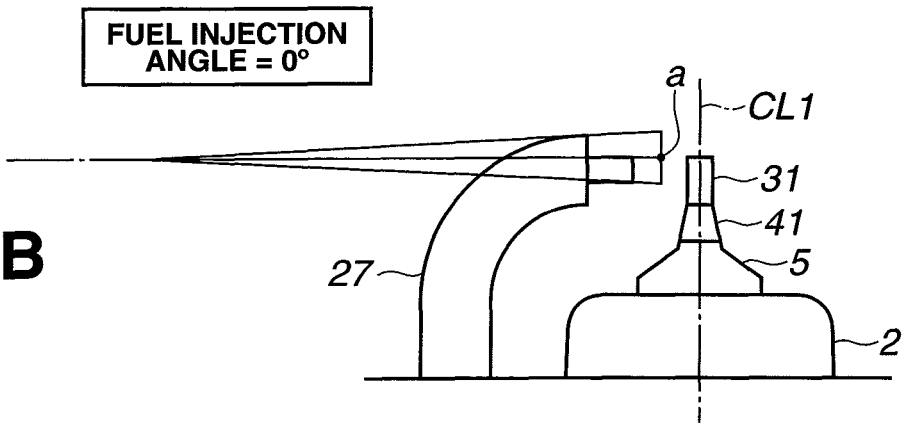
Figure 23C:
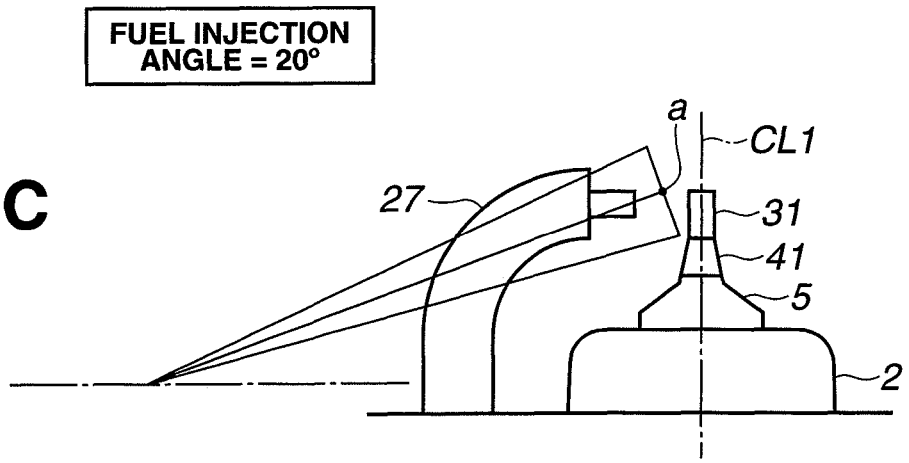

The test sample was subjected to ignition performance test. The ignition performance test was conducted by placing the test sample in a pressure chamber with a pressure sensor, injecting gasoline (as fuel) toward the test sample at various angles and checking the occurrence of ignition under the conditions of an initial chamber pressure of 1 MPa, a fuel injection pressure of 20 MPa and an air-fuel ratio (A/F) of 25. Fuel injection models at injection angles of −15 degrees, 0 degree and 20 degrees are illustrated in FIGS. 23A, 23B and 23C, respectively. The occurrence of ignition was judged based on the waveform of the pressure sensor. The ignition rate was determined as the number of times the ignition occurred when the test was repeated 30 times. The test results are indicated in FIG. 24.

A test sample of comparative spark plug (as Comparative Example) was produced and subjected to ignition performance test in the same manner, except that the comparative test sample had no flat region on the ground electrode and had a dimension of D=0.45 mm. The test results are also indicated in FIG. 24.

Figure 24:
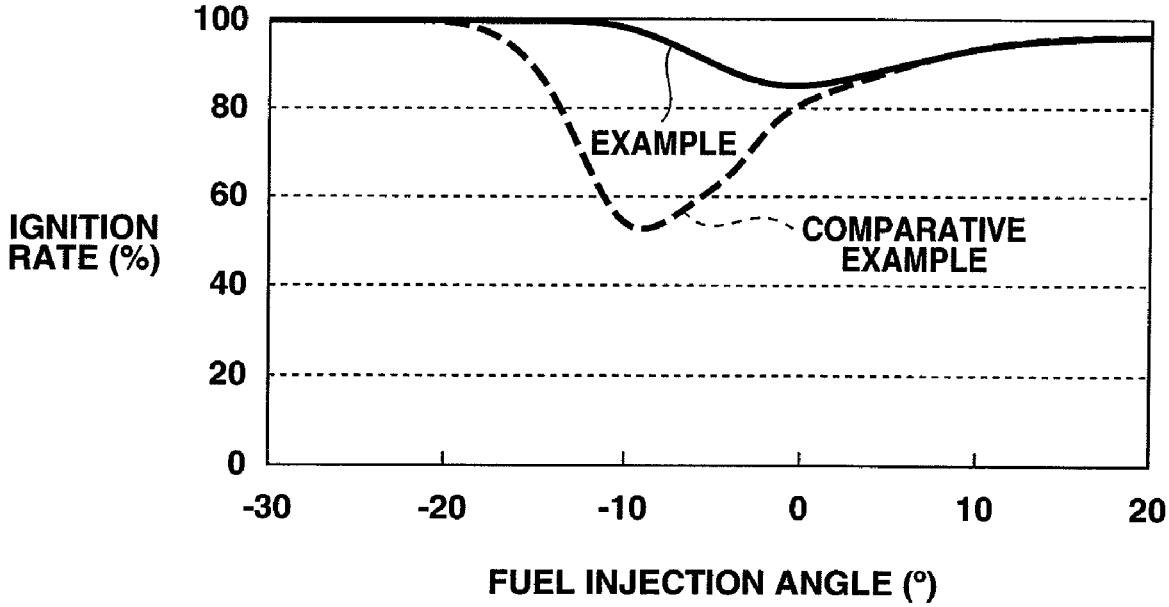
FIG. 24 is a graph showing the results of ignition performance evaluation in Experiment 3.

As seen from FIG. 24, the ignition rate of Comparative Example was deteriorated when the fuel injection angle was −20 to 10 degrees. On the other hand, there was not so large ignition rate deterioration in Example even when the fuel injection angle was −20 to 10 degrees. The ignition rate of Example was much higher than that of Comparative Example. The greatest difference in ignition rate between Example and Comparative Example was observed when the fuel injection angle was −10 degrees. It has been thus shown that the engine ignition performance can be improved significantly even at a fuel injection angle of −20 to 10 degrees by forming the flat region 51 on the ground electrode 27.

EXPERIMENT 4

Test samples of the spark plug 100 were produced by varying the longitudinal length A and lateral width B of the flat region 51. Each of the test samples was tested for ignition rate at a fuel ignition angle of −10 degrees in the same manner as in Experiment 3. The test results are indicated in FIG. 25.

Figure 25:
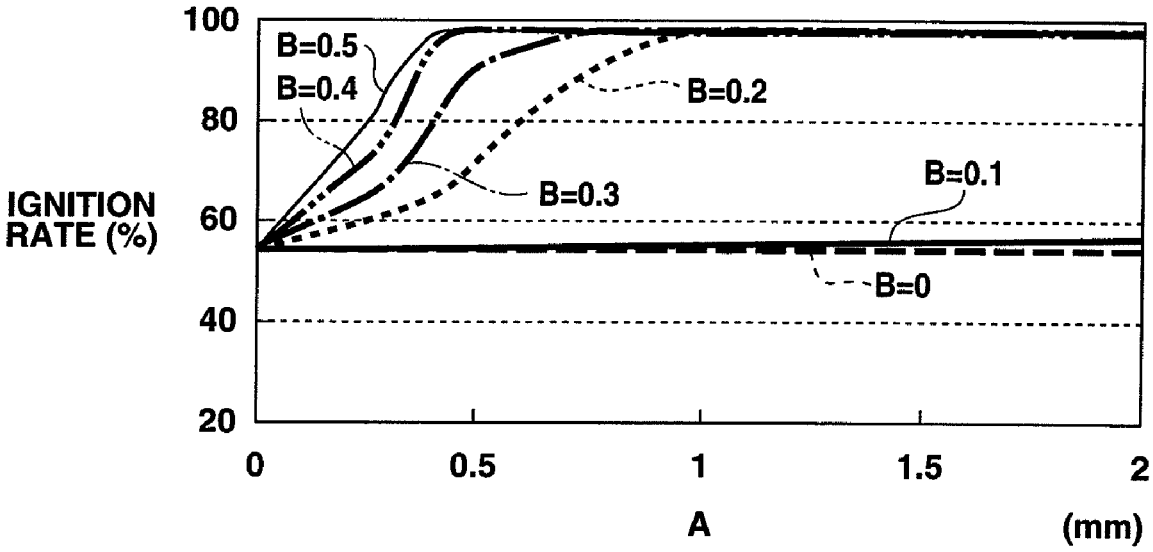
FIG. 25 is a graph showing the results of ignition performance evaluation in Experiment 4.

As seen from FIG. 25, the ignition rate was relatively low, regardless of whether A≧0.2 mm, when B<0.2 mm. The ignition rate was also relatively low when the surface area A×B of the flat region 51 was smaller than 0.2 $mm^2$. It has been shown by this experiment that the effect of the flat region 51 can be obtained assuredly by satisfaction of the conditions of A×B≧0.2 $mm^2$ and B≧0.2 mm.

EXPERIMENT 5

Test samples of the spark plug 100 were produced by varying the protrusion length F of the precious metal tip 32. Each of the test samples was subjected to durability test to evaluate the amount of increase of the spark gap 33 due to wear of the precious metal tip 32. The durability test was conducted by mounting the test sample in a 2.0-L six-cylinder engine, driving the engine continuously for 100 hours at 5000 rpm (full load) and measuring the amount of increase of the spark gap 33 during the test. The test results are indicated in FIG. 26.

Figure 26:
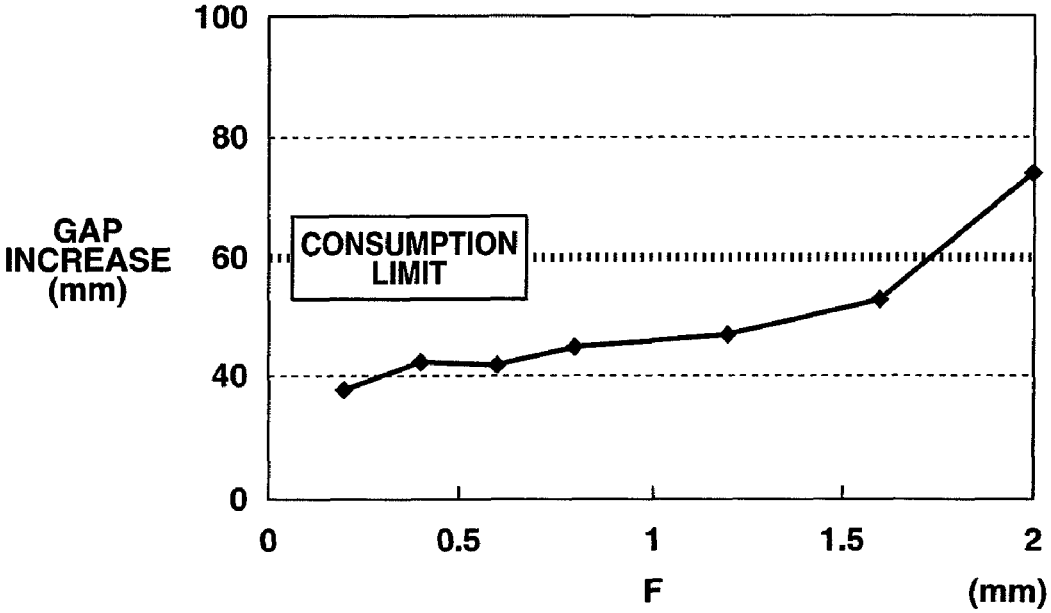
FIG. 26 is a graph showing the results of durability test in Experiment 5.

As seen from FIG. 26, the amount of wear of the precious metal tip 32 significantly increased so that the gap increase amount exceeded its consumption limit of 2.0 mm when F>1.6 mm. It has been confirmed that the heat transfer performance becomes insufficient as the protrusion length F (length dimension) of the precious metal tip 32 increases.

EXPERIMENT 6

Test samples of the spark plug 100 were produced by varying the dimensions D and E of the ground electrode 27. In the test samples, the longitudinal length A and lateral width B of the flat region 51 were controlled to 1.0 mm and 0.4 mm, respectively. Each of the test samples was tested for ignition rate at a fuel ignition angle of −10 degrees in the same manner as in Experiment 3. The test results are indicated in FIG. 27.

Figure 27:
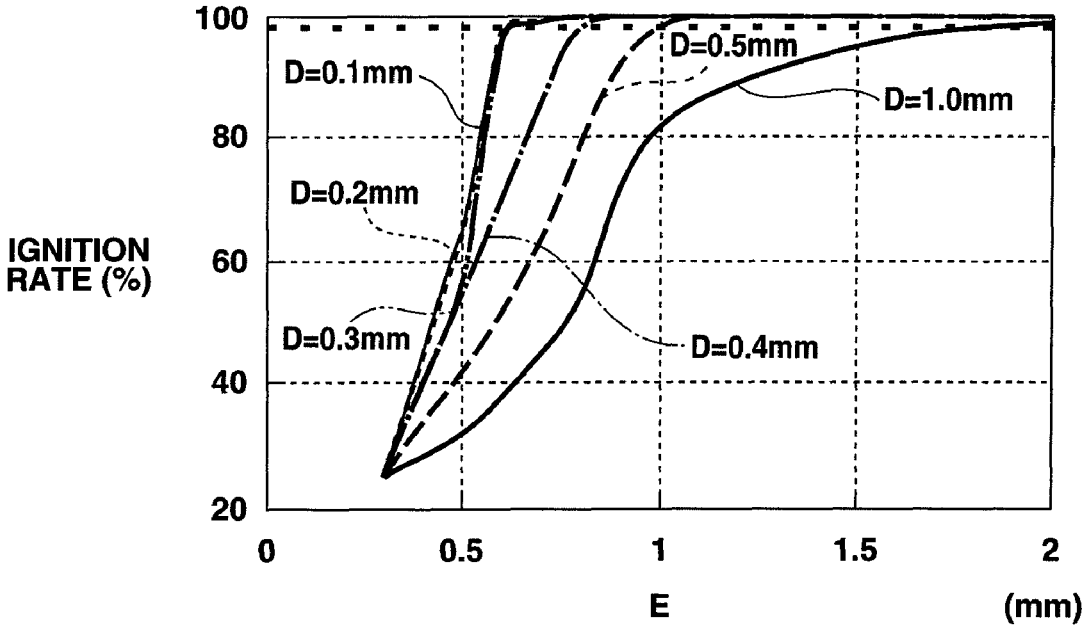
FIG. 27 is a graph showing the results of ignition performance evaluation in Experiment 6.

As seen from FIG. 27, the ignition rate was high when D<0.3 mm or E≧0.6 mm and when D≧0.3 mm and E≧2×D mm. In view of the fact that the equation 2D−C/2≦1.6, i.e., D≦C/4+0.8 holds based on the equations F≧1.6 and F=E−C/2, the upper limit of the distance D is set to C/4+0.8. It has been confirmed that the effect of the flat region 51 can be obtained assuredly by satisfaction of the conditions of D<0.3 mm and E≧0.6 mm or by satisfaction of the conditions of 0.3≦D≦C/4+0.8 mm and E≧2×D mm.

The entire contents of Japanese Patent Application No. 2007-327314 (filed on Dec. 19, 2007) and No. 2007-336219 (filed on Dec. 27, 2007) are herein incorporated by reference.

Although the present invention has been described with reference to the above specific embodiment, the invention is not limited to this exemplary embodiment. Various modification and variation of the embodiment described above will occur to those skilled in the art in light of the above teachings.

For example, the spark plug 1, 100 can alternatively be provided with two or more ground electrodes 27 although the spark plug 1, 100 has a single ground electrode 27 in the above embodiment.

The center electrode 5 and the ground electrode 27 are not limited to the above two-layer structures. Each of the center electrode 5 and the ground electrode 27 may have a multi-layer structure of three or more layers. In this case, it is preferable that the metal material of the inner electrode layer exhibits higher thermal conductivity than the metal material of the outer electrode layer for efficient heat transfer. For example, the center electrode 5 and the ground electrode 27 can be formed with a three-layer structure having an inner layer of pure nickel, an intermediate layer of pure copper or cupper alloy and an outer layer of nickel etc. Alternatively, each of the center electrode 5 and the ground electrode 27 may have a single-layer structure of e.g. nickel.

Figure 19:
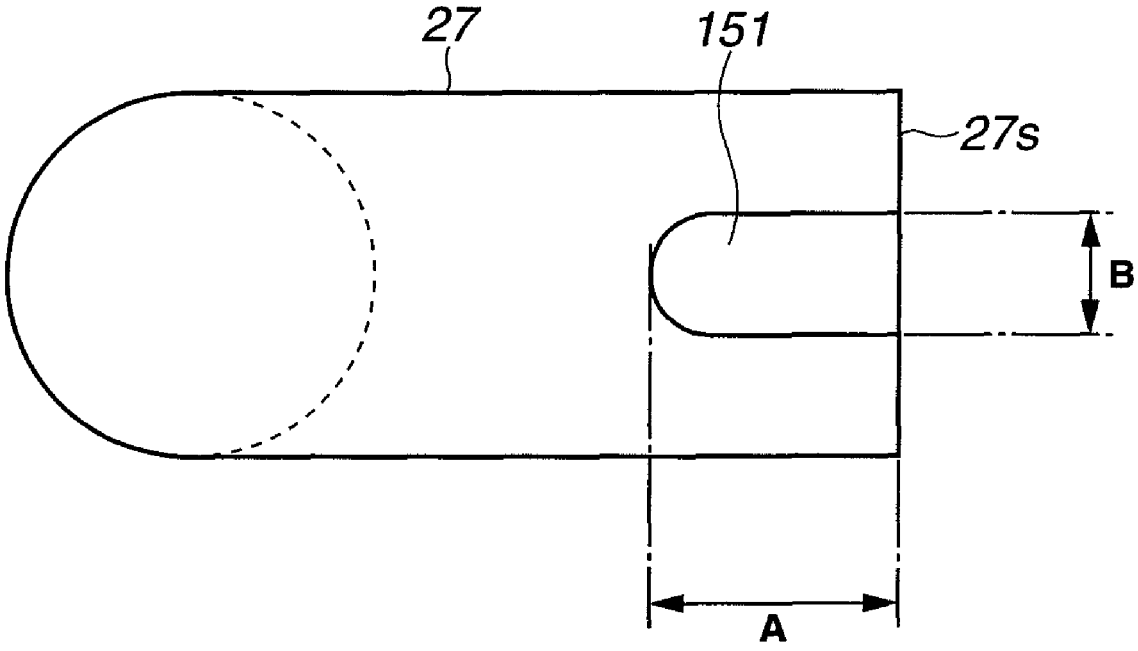
FIG. 19 is a plan view of yet another embodiment of the ground electrode according to the first or second embodiment of the present invention.

The flat region 51 may be not exactly flat but may be nearly flat and slightly concave as long as the flat region 51 is capable of guiding the air-fuel mixture to the spark gap 33 without causing a concentration of thermal shock vectors of the fuel. Further, the form of the flat region 51 is not limited to the rectangular. The ground electrode 27 may have a flat region 151 of any shape other than rectangular as shown in FIG. 19. In this case, the longitudinal length A of the flat region 151 is defined as the length from the front end face 27*s* of the ground electrode 27 to a point of the flat region 151 located farthest away from the front end face 27*s* of the ground electrode 27 in the longitudinal direction of the ground electrode 27; and the lateral width B of the flat region 151 is defined as the width along the front end face 27*s* of the ground electrode 27.

The scope of the invention is defined with reference to the following claims.

What is claimed is:

1. A spark plug for an internal combustion engine, comprising:

a cylindrical metal shell arranged in an axial direction of the spark plug;

a cylindrical insulator retained in the metal shell;

a column-shaped center electrode disposed in the insulator with a front end thereof protruding from the insulator; and a ground electrode joined at a rear end thereof to a front end of the metal shell and bent in such a manner that a front end of the ground electrode extends toward an axis of the spark plug so as to define a spark gap between the front end of the center electrode and the front end of the ground electrode, the ground electrode including a flat region formed on an outer peripheral surface thereof opposite to an inner peripheral surface facing the insulator, the flat region being located on the front end of the ground electrode and having a length of 0.2 mm or more from a front end face of the ground electrode in a longitudinal direction of the ground electrode, any region other than the flat region of the outer peripheral surface of the ground electrode being convex curved, the ground electrode satisfying the following dimensional condition (1) with respect to a first cross section of the ground electrode taken through said any region other than the flat region in a direction perpendicular to the longitudinal direction of the ground electrode and a second cross section of the ground electrode taken through the flat region in a direction perpendicular to the longitudinal direction of the ground electrode, $$0.950 \leqq (S2/L2)/(S1/L1) \leqq 0.995 \quad (1)$$

where S1 is the area of the first cross section; L1 is the perimeter of the first cross section; S2 is the area of the second cross section; and L2 is the perimeter of the second cross section.

2. The spark plug according to claim 1, wherein said any region other the flat region is formed into a circular arc with a curvature radius of 0.5 mm to 1.0 mm.

3. The spark plug according to claim 1, further comprising a precious metal tip disposed on the front end face of the ground electrode and protruding toward the axis of the spark plug so as to define the spark gap between an end face of the precious metal tip and an outer peripheral surface of the front end of the center electrode, wherein the flat region forms an angle of 70 to 100 degrees with respect to the front end face of the ground electrode.

4. The spark plug according to claim 3, wherein the flat region satisfies the following dimensional conditions (2) and (3):

$$A \times B \geqq 0.2 \quad (2); \text{ and}$$

$$B \geqq 0.2 \quad (3)$$

where A (mm) is the length of the flat region in the longitudinal direction of the ground electrode; and B (mm) is the width of the flat region in a direction perpendicular to the longitudinal direction of the ground electrode.

5. The spark plug according to claim 3, wherein the spark plug satisfies the following dimensional conditions (4), (5) and (6):

$$E \geqq 2 \times D \text{ when } 0.3 \leqq D \leqq C/4+0.8 \quad (4);$$

$$E \geqq 0.6 \text{ when } D<0.3 \quad (5); \text{ and}$$

$$F \leqq 1.6 \quad (6)$$

where C (mm) is the minimum radial distance of the spark gap; D (mm) is the axial distance from a midpoint of the shortest line connecting a front edge of the end face of the precious metal tip and a front edge of the front end of the center electrode to the outer peripheral surface of the front end of the ground electrode; E (mm) is the radial distance from said midpoint to the front end face of the ground electrode; and F (mm) is the length of protrusion of the precious metal tip from the front end face of the ground electrode.

* * * * *